US012768189B2

(12) United States Patent
Ramon

(10) Patent No.: US 12,768,189 B2
(45) **Date of Patent: *Oct. 20, 2026**

(54) BASE MEMBER AND METHOD FOR ATTACHING AN UPWARDLY EXTENDING POST TO A SURFACE AND ITS USE

(71) Applicant: BOPLAN BV, Moorsele (BE)

(72) Inventor: Xavier Ramon, Moorsele (BE)

(73) Assignee: BOPLAN BV, Moorsele (BE)

( * ) Notice: Subject to any disclaimer, the term of this patent is extended or adjusted under 35 U.S.C. 154(b) by 109 days.

This patent is subject to a terminal disclaimer.

(21) Appl. No.: 18/868,904

(22) PCT Filed: May 30, 2023

(86) PCT No.: PCT/EP2023/064377
§ 371 (c)(1),
(2) Date: Nov. 25, 2024

(87) PCT Pub. No.: WO2023/232769
PCT Pub. Date: Dec. 7, 2023

(65) Prior Publication Data

US 2025/0297489 A1 Sep. 25, 2025

(30) Foreign Application Priority Data

May 30, 2022 (BE) ..... 2022/5414

(51) Int. Cl.
*E04H 12/22* (2006.01)

(52) U.S. Cl.
CPC ..... *E04H 12/2276* (2013.01); *E04H 12/2269* (2013.01)

(58) Field of Classification Search
CPC . E04H 12/22; E04H 12/2276; E04H 12/2269; E04H 12/2253; E04B 2001/389; E01F 9/681; E01F 9/673; E01F 9/602
USPC ..... 52/298, 706, 169.9
See application file for complete search history.

(56) References Cited

U.S. PATENT DOCUMENTS 3,451,319 A 6/1969 Gubela
4,288,312 A * 9/1981 Johnson ..... C25C 7/02 204/288.3
4,588,157 A * 5/1986 Mills ..... E04H 12/2215 52/165

(Continued)

FOREIGN PATENT DOCUMENTS

DE 19846370 A1 7/1999

*Primary Examiner* — Christine T Cajilig
(74) *Attorney, Agent, or Firm* — Vorys, Sater, Seymour and Pease, LLP; Iona N. Kaiser

(57) ABSTRACT

The current invention relates to a base member for attaching an upwardly extending post to a surface, comprising a bottom plate and a hollow connection profile, wherein the connection profile comprises at least a first pair of cuts, wherein a cut forms a pliable lip, wherein the pliable lip extends in a direction transverse to the bottom plate, wherein a first cut is comprised in a first side and a second cut in a second side of the connection profile, opposite said first side, wherein both cuts are at a same distance from the bottom plate, wherein both pliable lips formed by the cuts are oriented in a same direction, wherein said first pair comprises a bolt, and wherein said bolt is placed in a threaded hole in the pliable lip formed by the first cut. The invention also relates to a method and a use.

15 Claims, 27 Drawing Sheets

(56) References Cited

U.S. PATENT DOCUMENTS

| | | | | |
|---|---|---|---|---|
| 7,296,386 | B2 * | 11/2007 | Leek | E04H 12/2238 52/707 |
| 9,102,092 | B2 * | 8/2015 | Mukith | B29C 65/64 |
| 9,551,121 | B2 * | 1/2017 | McCord | E01F 9/608 |
| 2012/0321826 | A1 | 12/2012 | Mukith et al. | |
| 2020/0056338 | A1 * | 2/2020 | Coglitore | E01F 9/685 |

* cited by examiner

BASE MEMBER AND METHOD FOR ATTACHING AN UPWARDLY EXTENDING POST TO A SURFACE AND ITS USE

FIELD OF THE INVENTION

The present invention relates to a base member for attaching an upwardly extending post to a surface. The present invention also relates to a method for attaching an upwardly extending post to a surface and to a use of the base member and/or the method for creating a collision protection.

BACKGROUND

Upwardly extending posts are known and are frequently used as part of a fence or a collision protection. In particular in case of a collision protection, the upwardly extending posts are placed on a surface inside a building, such as a warehouse, or on a paved area, such as a parking lot. It is in these conditions simply not possible to anchor an upwardly extending post in a hole in the surface. This is also not recommended because these upwardly extending posts have to be replaceable when damaged after a collision. Therefore, these upwardly extending posts are connected to a base member that is attached on the surface. The upwardly extending posts have to be firmly connected to the base members to avoid that the upwardly extending posts are released from the base members in case of a mechanical impact.

A method for connecting an upwardly extending post to a base member is known from US 2012/0321826 (US '826). US '826 describes that the upwardly extending post is a hollow component, formed by extruding plastics material. A rigid support member and the hollow component are forced together such that the hollow component slides over the support member. The hollow member deforms elastically as it moves relatively over the base member, such that the two hollow component and the support member are secured together.

This known method has the disadvantage that the hollow component is secured to the support member in a non-detachable way. This means that in case of damage to an upwardly extending post, it is not possible to only replace the upwardly extending post. Both the support member and the hollow member need to be detached from the surface and replaced. This results in a waste of material, as the support member is often undamaged. It also requires additional work to replace the upwardly extending post, as a new support member has to be attached to the surface and a new hollow member has to be connected to the support member, instead of only replacing the broken hollow member.

The present invention aims to resolve at least the problem mentioned above.

SUMMARY OF THE INVENTION

To this end, the present invention relates to a base member according to claim 1.

The advantage of such a base member is that an upwardly extending post can be firmly attached to the base member, while remaining detachable. By tightening the bolt, the pliable lips formed by the first cut and the second cut will be clamped against the upwardly extending post. This causes sufficient friction between the base member and the upwardly extending post, so that the base member and the upwardly extending post are firmly secured to each other.

This is additionally beneficial because energy of a mechanical impact on the upwardly extending post is transferred via these pliable lips, and not only via the bolt, avoiding high tension on a single point and significantly reducing the risk on failure of the bolt. In case the upwardly extending post gets damaged, the upwardly extending post can be detached from the base member by loosening the bolt. The pliable lips will at least partly return towards an original position at the first side and the second side of the connection profile, and will not be any longer clamped against the upwardly extending post. The upwardly extending post and the connection profile are not any longer secured to each other. The base member can be reused for attaching a replacement upwardly extending post. Only the replacement upwardly extending post needs to be reattached to the base member.

Preferred embodiments of the device are shown in any of the claims 2 to 9.

In a second aspect, the present invention relates to a method according to claim 10.

More particular, the method as described herein provides that the upwardly extending post is attached to the base member by tightening a bolt.

Pliable lips formed by the first cut and the second cut will be clamped against the upwardly extending post, causing sufficient friction between the base member and the upwardly extending post to firmly secure them to each other. In case the upwardly extending post gets damaged, the upwardly extending post can be detached from the base member by loosening the bolt. This is a simple and fast action. The base member can be reused for attaching a replacement upwardly extending post. Only the replacement upwardly extending post needs to be reattached to the base member by tightening again the bolt.

Preferred embodiments of the method are shown in any of the claims 10 to 14.

In a third aspect the present invention relates to a use according to claim 15. The use as described herein provides an advantageous effect. Upwardly extending posts are firmly attached to base members so that upwardly extending posts are suited for creating a collision protection. The upwardly extending posts will not detach from the base member in case of mechanical impact on the upwardly extending post, which is an essential requirement for a collision protection. The upwardly extending post can be easily and quickly replaced in case of damage after a collision, while the base member can be reused. The occurrence of damage to an upwardly extending post of a collision protection is rather high compared to an upwardly extending post of for instance a fence, increasing the importance of simple replacement and reuse of material.

In a fourth aspect, the invention relates to an assembly of a base member and an upwardly extending post.

This embodiment is beneficial to guarantee that the upwardly extending post can be firmly secured to the base member. This makes the assembly especially beneficial for use as collision protection or as part of a fence.

DETAILED DESCRIPTION OF THE INVENTION

Figure 1A:
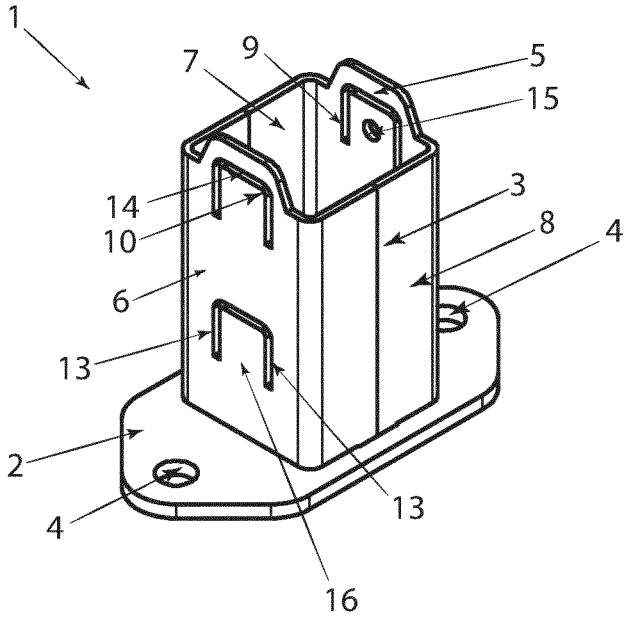
FIGS. 1A-1E show different views of a base member according to a first embodiment of the present invention, before tightening the bolt.

Unless otherwise defined, all terms used in disclosing the invention, including technical and scientific terms, have the meaning as commonly understood by one of ordinary skill in the art to which this invention belongs. By means of further guidance, term definitions are included to better appreciate the teaching of the present invention.

As used herein, the following terms have the following meanings:

"A", "an", and "the" as used herein refers to both singular and plural referents unless the context clearly dictates otherwise. By way of example, "a compartment" refers to one or more than one compartment.

"Comprise", "comprising", and "comprises" and "comprised of" as used herein are synonymous with "include", "including", "includes" or "contain", "containing", "contains" and are inclusive or open-ended terms that specifies the presence of what follows e.g. component and do not exclude or preclude the presence of additional, non-recited components, features, element, members, steps, known in the art or disclosed therein.

Furthermore, the terms first, second, third and the like in the description and in the claims, are used for distinguishing between similar elements and not necessarily for describing a sequential or chronological order, unless specified. It is to be understood that the terms so used are interchangeable under appropriate circumstances and that the embodiments of the invention described herein are capable of operation in other sequences than described or illustrated herein.

The recitation of numerical ranges by endpoints includes all numbers and fractions subsumed within that range, as well as the recited endpoints.

Whereas the terms "one or more" or "at least one", such as one or more or at least one member(s) of a group of members, is clear per se, by means of further exemplification, the term encompasses inter alia a reference to any one of said members, or to any two or more of said members, such as, e.g., any ≥3, ≥4, ≥5, ≥6 or ≥7 etc. of said members, and up to all said members.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to a person skilled in the art from this disclosure, in one or more embodiments. Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the context of this document, extending substantially perpendicular to a plane, for instance a surface or a plate, means that the angle between a direction wherein something extends to and the plane is 90°±15°, preferably 90°±10°, more preferably 90°±5° and even more preferably 90°±3°.

In a first aspect, the invention relates to a base member for attaching an upwardly extending post to a surface.

In a preferred embodiment the base member comprises a bottom plate and a hollow connection profile for connecting the upwardly extending post to the base member. The base member is preferably made of metal, more preferably steel. The bottom plate is intended to be placed with one side on the surface. The surface is for instance a concrete floor of a warehouse or an asphalt surface of a parking lot. The bottom plate comprises holes for attaching the base member to the surface by using bolts, screws, anchors or other suitable means. The bottom plate comprises at least two holes. The connection profile is firmly fixed to the bottom plate. Preferably the connection profile is welded to the bottom plate. The connection profile extends along a longitudinal direction. The connection profile extends in a direction transverse to the bottom plate. This means that the longitudinal direction of the connection profile is substantially perpendicular to the bottom plate and when installed on a surface substantially perpendicular to the surface. The connection profile has a rectangular, circular, hexagonal or another suitable shape as a cross-section in a plane transverse to the longitudinal direction.

The connection profile comprises at least a first pair of cuts. With cut is meant that a side of the connection profile is completely pierced by the cut. A cut forms a pliable lip. The pliable lip extends in a direction transverse to the bottom plate. This means that the pliable lip is oriented according to the longitudinal direction of the connection profile. The cut has a U-shape, V-shape, the shape of a circular arc or another suitable shape to form a pliable lip. A U-shaped cut has two legs and a cross-connection. The cross-connection connects the two legs of the U-shaped cut. The legs are oriented transverse to the bottom plate.

A first cut of said first pair of cuts is comprised in a first side of the connection profile. Said first side extends along the longitudinal direction of the connection profile. A second cut of said first pair of cuts is comprised in a second side of the connection profile. Said second side is opposite said first side. Both cuts of said first pair are at a same distance from the bottom plate. The distance is measured perpendicularly to the bottom plate. Both pliable lips formed by the cuts of said first pair are oriented in a same direction. This means that tips of the pliable lips formed by the cuts of said first pair are oriented towards a same point, for instance the bottom plate of the base member.

The base member comprises a bolt. Said bolt is placed in a threaded hole in the pliable lip formed by the first cut of said first pair. The threaded hole has a threaded pitch that corresponds to the threaded pitch of said bolt.

This embodiment is advantageous because an upwardly extending post can be firmly attached to the base member, while remaining detachable. The upwardly extending post is a hollow profile slid over the connection profile of the base member. By tightening the bolt, the pliable lips formed by the first cut and the second cut will be clamped against the upwardly extending post. This causes sufficient friction between the base member and the upwardly extending post, so that the base member and the upwardly extending post are firmly secured to each other. Depending on the material of the upwardly extending post, these zones partly penetrate a surface at an inside of the upwardly extending post, even making the base member and the upwardly extending post more secured to each other. This embodiment is additionally beneficial because energy of a mechanical impact on the upwardly extending post is transferred via these pliable lips, and not only via the bolt, avoiding high tension on a single point and significantly reducing the risk on failure of the bolt. In case the upwardly extending post gets damaged, the upwardly extending post can be detached from the base member by loosening the bolt. The pliable lips will at least partly return towards an original position at the first side and the second side of the connection profile, and will not be any longer clamped against the upwardly extending post. The upwardly extending post and the connection profile are not any longer secured to each other. The base member can be reused for attaching a replacement upwardly extending post. Only the replacement upwardly extending post needs to be reattached to the base member.

In a preferred embodiment the connection profile comprises at least a second pair of cuts. A cut forms a pliable lip, wherein the pliable lip extends in a direction transverse to the bottom plate. A first cut of said second pair of cuts is comprised in a third side of the connection profile. Said third side extends along the longitudinal direction of the connection profile. A second cut of said second pair of cuts is comprised in a fourth side of the connection profile. Said fourth side is opposite said third side. The third side and the fourth side of the connection profile are transverse to the first side and the second side of the connection profile. Both cuts of said second pair are at a same distance from the bottom plate. The distance is measured perpendicularly to the bottom plate. Both pliable lips formed by the cuts of said second pair are oriented in a same direction. This means that tips of the pliable lips formed by the cuts of said second pair are oriented towards a same point, for instance the bottom plate of the base member.

The base member comprises a second bolt. Said second bolt is placed in a threaded hole in the pliable lip formed by the first cut of said second pair. The threaded hole has a threaded pitch that corresponds to the threaded pitch of said second bolt. The second bolt in the pliable lip formed by the first cut of said second pair is at a different distance from the bottom plate than the bolt in the pliable lip formed by the first cut of said first pair. The second bolt in the pliable lip formed by the first cut of said second pair and the bolt in the pliable lip formed by the first cut of said first pair have preferably an equal threaded pitch. This is advantageous for exchanging both bolts.

This embodiment is advantageous for firmly attaching an upwardly extending post to a base member when the upwardly extending post can be exposed to high impact energies from several directions. Due to the at least second pair of cuts, the impact energy is distributed over at least two additional pliable lips, reducing the risk on failure and the upwardly extending post detaching from the base member. Because the cuts of the second pair of cuts are comprised in sides transverse to the side comprising the cuts of the first pair, the impact energy will be substantially equally distributed over the different zones, independent of a direction of origin of the impact.

In a further embodiment a tip of the pliable lips formed by the cuts of said first pair of cuts are oriented towards the bottom plate and a tip of the pliable lips formed by the cuts of said second pair of cuts are oriented away from the bottom plate.

A tip of a pliable lip formed by a cut that is oriented towards the bottom plate is beneficial for an optimal attachment of the upwardly extending post to the base member. After tightening the bolt in the pliable lip formed by the cut, the pliable lips form winglets pointing towards the bottom plate of the base member, increasing a force required to detach the upwardly extending post from the base member.

A tip of a pliable lip formed by a cut that is oriented away from the bottom plate is beneficial for ease of placement of the upwardly extending post. While tightening the bolt in the pliable lip formed by the cut, the pliable lips form winglets pointing away from the bottom plate of the base member, pushing the upwardly extending post to the bottom plate. This is especially beneficial when the upwardly extending post has inner dimensions that are close to outer dimensions of the connection profile.

This embodiment is advantageous for having both a secure attachment of the upwardly extending post to the base member and an easy placement of the upwardly extending post. By first tightening the second bolt, the upwardly extending post is pushed towards the bottom plate and by tightening secondly the bolt for the first pair, a force required to detach the upwardly extending post from the base member is significantly increased.

In an alternative embodiment a tip of the pliable lips formed by the cuts of said first pair and a tip of the pliable lips formed by the cuts of said second pair are oriented in a same direction. The tip of the pliable lips formed by the cuts of said first pair and the tip of the pliable lips formed by the cuts of said second pair are oriented away from the bottom plate or the tip of the pliable lips formed by the cuts of said first pair and the tip of the pliable lips formed by the cuts of said second pair are oriented towards the bottom plate.

Having the tip of the pliable lips formed by the cuts of said first pair and the tip of the pliable lips of the cuts of said second pair oriented towards the bottom plate is advantageous when a force required to detach the upwardly extending post from the base member needs to be maximized.

Having the tip of the pliable lips formed by the cuts of said first pair and the tip of the pliable lips formed by the cuts of said second pair oriented away from the bottom plate is advantageous when ease of placement of the upwardly extending post needs to be maximized.

In a preferred embodiment a pair of cuts is part of a series of at least two pairs of cuts. The base member can comprise one series of at least two pair of cuts, wherein the series of at least two pair of cuts comprises said first pair or said second pair. The base member can comprise two series of at least two pairs of cuts, wherein a first series comprises said first pair and a second series comprise said second pair. A pair of cuts is similar as described in previous embodiments. All cuts of a series of at least two pairs of cuts are comprised in the same two sides of the connection profile as said first pair when said first pair is comprised in the series, or are comprised in the same two sides of the connection profile as said second pair when said second pair is comprised in the series. Each subsequent pair of cuts of said series is located at increasing distance from said bottom plate. Every pair of cuts of a series of at least two pairs of cuts comprises a first cut and a second cut. The base member comprises a bolt for every pair of cuts of a series of at least two pairs of cuts. Every bolt is placed in a threaded hole in a pliable lip formed by the first cut of a pair of cuts, as described in previous embodiments.

This embodiment is advantageous when a single pair of cuts is insufficient to firmly secure an upwardly extending post to a base member. This is especially advantageous in case the upwardly extending post is part of a collision protection.

In a further embodiment the pliable lips formed by the cuts of all pairs of said series are oriented in a same direction. This means that the tips of the pliable lips formed by all cuts of all pairs of said series are oriented away from the bottom plate or are oriented towards the bottom plate.

Having the tips of the pliable lips formed by all cuts of all pairs of said series oriented towards the bottom plate is advantageous when a force required to detach the upwardly extending post from the base member needs to be maximized.

Having the tips of the pliable lips formed by all cuts of all pairs of said series oriented away from the bottom plate is advantageous when ease of placement of the upwardly extending post needs to be maximized.

In an alternative embodiment, the pliable lips formed by the cuts of subsequent pairs of cuts of said series are oriented in opposite directions. This means that the tips of the pliable lips formed by the cuts of subsequent pairs of said series are oriented alternately away from the bottom plate and oriented towards the bottom plate.

This embodiment is advantageous for having both a secure attachment of the upwardly extending post to the base member and an easy placement of the upwardly extending post.

In a preferred embodiment the base member is made of steel. Steel is beneficial to give sufficient strength to the base member to avoid that the base member breaks when having a high energy impact on the upwardly extending post. Steel is especially beneficial because it has a high modulus of elasticity. This allows the pliable lips to deform in an elastic way. As a result, the pliable lips will at least partly return towards an original position at the sides of the connection profile after loosening the bolt, and will not be any longer clamped against the upwardly extending post, allowing to detach the upwardly extending post from the base member.

Preferably the modulus of elasticity of the steel is at least 180 GPa, more preferably 190 GPa, even more preferably at least 200 GPa and most preferably at least 210 GPa.

In a preferred embodiment, the bolt placed in a threaded hole in a pliable lip formed by a cut of a pair of cuts has a length which is at least 5 mm and at most 15 mm longer than a distance between the two opposite sides of the connection profile comprising said cuts of said pair. Said distance is measured at an outside of the connection profile.

Preferably the bolt has a length which is at least 6 mm longer than said distance, more preferably at least 7 mm, even more preferably at least 8 mm and most preferably at least 9 mm.

Preferably the bolt has a length which is at most 14 mm longer than said distance, more preferably at most 13 mm, even more preferably at most 12 mm and most preferably 11 mm.

A bolt with a length within the given range is beneficial because the bolt can be sufficiently tightened such that the pliable lips are clamped against the upwardly extending post, while on the other hand the bolt is not so long that the bolt can be tightened so much that plastic deformation of the pliable lips occurs. Additionally, after completely tightening the bolt, the bolt is adjacent to the upwardly extending post. This is beneficial to avoid that a person is hurt by extending bolts.

In an embodiment the bottom plate is an elongated plate that extends in a first direction. In a second direction transverse to said first direction, the bottom plate is at most 10 mm wider than the connection profile, preferably at most 8 mm, more preferably at most 6 mm. The bottom plate comprises two holes for attaching the base member to the surface. The holes are positioned at two opposite sides of the connection profile according to the first direction. This embodiment is especially beneficial when the upwardly extending post is part of a collision protection, comprising a kerb barrier. A kerb barrier comprises an elongated hollow profile that is installed on a surface, preferably by the use of bolts, screws, anchors or other suitable means. A kerb barrier is used to avoid that a vehicle at low speed is crossing a certain line at low speed. The wheels of the vehicle will hit the kerb barrier and the vehicle is stopped. The elongated shape of the bottom plate makes the base member suited for installation inside the kerb barrier. The upwardly extending post can be attached to a hidden base member, also hiding the bolt.

In an embodiment the bottom plate has a rectangular shape, and the connection profile has a rectangular cross-section. The rectangular shape corresponds with the rectangular cross-section of the connection profile. The connection profile is centrally placed inside the circumference of the bottom plate. A distance between a side of the bottom plate and a closest side of the connection profile is at least 5 mm, preferably at least 7 mm, more preferably at least 9 mm and even more preferably at least 10 mm. Said distance is measured perpendicularly on said side of the bottom plane in a plane formed by the bottom plane. The bottom plate comprises four holes for attaching the base member to the surface. The bottom plate comprises a hole in each corner of the bottom plate. This embodiment is beneficial for firmly attaching an upwardly extending post to a surface, especially a free-standing upwardly extending post that can be exposed to high impact energies from several directions.

Because the bottom plate comprises a hole in each corner, the impact energy will be substantially equally distributed over these four holes, independent of a direction of origin of the impact.

In a second aspect the invention relates to a method for attaching an upwardly extending post to a surface.

In a preferred embodiment the method comprises the steps of:

- providing a base member, wherein the base member comprises a bottom plate and a hollow connection profile for connecting the upwardly extending post to the base member;
- attaching the base member to the surface;
- sliding the upwardly extending post over the connection profile;
- and the additional step of attaching the upwardly extending post to the connection profile by the use of a bolt.

The base member is preferably made of metal, more preferably steel. The bottom plate is intended to be placed with one side on the surface. The bottom plate comprises holes for attaching the base member to the surface by using bolts, screws, anchors or other suitable means. The bottom plate comprises at least two holes. The connection profile is firmly fixed to the bottom plate. The connection profile extends along a longitudinal direction. The connection profile extends in a direction transverse to the bottom plate. The connection profile has a rectangular, circular, hexagonal or another suitable shape as a cross-section in a plane transverse to the longitudinal direction.

The connection profile comprises at least a first pair of cuts. With cut is meant that a side of the connection profile is completely pierced by the cut. A cut forms a pliable lip. The pliable lip extends in a direction transverse to the bottom plate. This means that the pliable lip is oriented according to the longitudinal direction of the connection profile. The cut has a U-shape, V-shape, the shape of a circular arc or another suitable shape to form a pliable lip. The cross-connection connects the two legs of the U-shaped cut. A U-shaped cut has two legs and a cross-connection. The legs are oriented transverse to the bottom plate.

A first cut of said first pair of cuts is comprised in a first side of the connection profile. Said first side extends along the longitudinal direction of the connection profile. A second cut of said first pair of cuts is comprised in a second side of the connection profile. Said second side is opposite said first side. Both cuts of said first pair are at a same distance from the bottom plate. The distance is measured perpendicularly to the bottom plate. Both pliable lips formed by the cuts of said first pair are oriented in a same direction. This means that tips of the pliable lips formed by the cuts of said first pair are oriented towards a same point, for instance the bottom plate of the base member.

Said bolt is placed in a threaded hole in the pliable lip formed by the first cut of said first pair. The threaded hole has a threaded pitch that corresponds to the threaded pitch of said bolt. Said bolt is tightened until the pliable lip formed by the first cut and the pliable lip formed by the second cut are clamped against the upwardly extending post. This causes sufficient friction between the base member and the upwardly extending post to firmly secure them to each other. This method is beneficial because in case the upwardly extending post gets damaged, the upwardly extending post can be detached from the base member by loosening the bolt. This is a simple and fast action. The base member can be reused for attaching a replacement upwardly extending post. Only the replacement upwardly extending post needs to be reattached to the base member by tightening again the bolt.

In a preferred embodiment the method comprises the additional step of attaching the upwardly extending post to the connection profile by the use of a second bolt.

The connection profile comprises at least a second pair of cuts. A cut forms a pliable lip. The pliable lip extends in a direction transverse to the bottom plate. A first cut of said second pair of cuts is comprised in a third side of the connection profile. Said third side extends along the longitudinal direction of the connection profile. A second cut of said second pair of cuts is comprised in a fourth side of the connection profile. Said fourth side is opposite said third side. The third side and the fourth side of the connection profile are transverse to the first side and the second side of the connection profile. Both cuts of said second pair are at a same distance from the bottom plate. The distance is measured perpendicularly to the bottom plate. Both pliable lips formed by the cuts of said second pair are oriented in a same direction. This means that tips of the pliable lips formed by the cuts of said second pair are oriented towards a same point, for instance the bottom plate of the base member.

Said second bolt is placed in a threaded hole of the pliable lip formed by the first cut of said second pair. The threaded hole has a threaded pitch that corresponds to the threaded pitch of said second bolt. The second bolt in the pliable lip formed by the first cut of said second pair is at a different distance from the bottom plate than the bolt in the pliable lip formed by the first cut of said first pair. Said second bolt is tightened until parts of the connection profile inside a zone formed by the two legs and the cross-connection of the first cut and the second cut of the second pair are clamped against the upwardly extending post.

This embodiment is advantageous for firmly attaching an upwardly extending post to a base member when the upwardly extending post can be exposed to high impact energies from several directions. Due to the at least second pair of cuts, the impact energy is distributed over at least two additional pliable lips, reducing the risk on failure and the upwardly extending post detaching from the base member. Because the cuts of the second pair of cuts are comprised in sides transverse to the side comprising the cuts of the first pair, the impact energy will be substantially equally distributed over the different pliable lips, independent of a direction of origin of the impact.

In a preferred embodiment a pair of cuts is part of a series of at least two pairs of cuts. The base member can comprise one series of at least two pair of cuts, wherein the series of at least two pair of cuts comprises said first pair or said second pair.

The base member can comprise two series of at least two pairs of cuts, wherein a first series comprises said first pair and a second series comprise said second pair. A pair of cuts is similar as described in previous embodiments. All cuts of a series of at least two pairs of cuts are comprised in the same two sides of the connection profile as said first pair when said first pair is comprised in the series, or are comprised in the same two sides of the connection profile as said second pair when said second pair is comprised in the series. Each subsequent pair of cuts of said series is located at increasing distance from said bottom plate. Every pair of cuts of a series of at least two pairs of cuts comprises a first cut and a second cut. The base member comprises a bolt for every pair of cuts of a series of at least two pairs of cuts. Every bolt is placed in a threaded hole in the pliable lip formed by the first cut of a pair of cuts, as described in previous embodiments. Every bolt is tightened until the pliable lips formed by the cuts are clamped against the upwardly extending post.

This embodiment is advantageous when a single pair of cuts is insufficient to firmly secure an upwardly extending post to a base member. This is especially advantageous in case the upwardly extending post is part of a collision protection.

In a preferred embodiment the method comprises the additional step of placing a kerb barrier. The kerb barrier comprises an elongated hollow profile that is installed on a surface, preferably by the use of bolts, screws, anchors or other suitable means. A kerb barrier is used to avoid that a vehicle at low speed is crossing a certain line at low speed. The wheels of the vehicle will hit the kerb barrier and the vehicle is stopped. The base member is hidden inside the kerb barrier. The upwardly extending post is slid over the connection profile of the base member through the kerb barrier. The bolt is tightened through an open end of the kerb barrier. It is clear that when the upwardly extending post is attached to the base member using multiple bolts, the multiple bolts are tightened through an open end of the kerb barrier. This embodiment is advantageous because the base member and the bolt or multiple bolts are hidden and protected by the kerb barrier.

In a preferred embodiment, the method comprises the additional step of removing the upwardly extending post after untightening the bolt. By untightening the bolt, the pliable lips formed by the first cut and the second cut will at least partly return towards an original position at the first side and the second side of the connection profile, and will not be any longer clamped against the upwardly extending post. The upwardly extending post and the connection profile are not any longer secured to each other. A damaged upwardly extending post can be replaced by a replacement upwardly extending post. The base member can be reused for attaching a replacement upwardly extending post. Only the replacement upwardly extending post needs to be reattached to the base member.

A person of ordinary skill in the art will appreciate that a base member according to the first aspect of the invention is suited for use in a method according to the second aspect of the invention and that a method according to the second aspect of the invention is preferably executed with a base member according to the first aspect of the invention. Accordingly, any feature described in this document, above as well as below, may relate to any of the four aspects of the present invention.

In a third aspect, the invention relates to a use of a base member according to the first aspect and/or a method according to the second aspect for creating a collision protection.

The use is advantageous because upwardly extending posts are firmly attached to base members, so that upwardly extending posts are suited for creating a collision protection. The upwardly extending posts will not detach from the base member in case of mechanical impact on the upwardly extending post, which is an essential requirement for a collision protection. The upwardly extending post can be easily and quickly replaced in case of damage after a collision, while the base member can be reused. The occurrence of damage to an upwardly extending post of a collision protection is rather high compared to an upwardly extending post of for instance a fence, increasing the importance of simple replacement and reuse of material.

In a fourth aspect, the invention relates to an assembly of a base member and an upwardly extending post.

In a preferred embodiment, the base member is a base member according to the first aspect. The upwardly extending post is an elongated hollow profile. The upwardly extending post is slid over the connection profile. This means that the upwardly extending post is extending in a direction parallel with the longitudinal direction of the connection profile. The upwardly extending post has a rectangular, circular, hexagonal or another suitable shape as a cross-section in a plane transverse to the longitudinal direction of the connection profile. The cross-section of the elongated hollow profile of the upwardly extending post corresponds with the cross-section of the connection profile. A distance between a side of the cross-section of the elongated hollow profile of the upwardly extending post and a closest side of the cross-section of the connection profile is at most 5 mm, preferably at most 4 mm, more preferably at most 3 mm, even more preferably at most 2 mm and most preferably at most 1 mm. Said distance is measured perpendicularly on said side of the cross-section of the elongated hollow profile of the upwardly extending post in said plane of the cross-section. The upwardly extending post is preferably made of a plastic material. This is especially beneficial for creating a collision protection, because plastic materials can elastically deform and absorb high energy impacts. Additional beneficial is that the pliable lips, formed by the first cut and the second cut, will partly penetrate a surface at an inside of the upwardly extending post when tightening the bolt, making the base member and the upwardly extending post more secured to each other.

This embodiment is beneficial to guarantee that the upwardly extending post can be firmly secured to the base member. The distance between the elongated profile of the upwardly extending post and the connection profile is small enough that by tightening the bolt, a pliable lip formed by the first cut and the second cut will be clamped against the upwardly extending post. This makes the assembly especially beneficial for use as collision protection or as part of a fence.

The invention is further described by the following non-limiting figures which further illustrate the invention, and are not intended to, nor should they be interpreted to, limit the scope of the invention.

DESCRIPTION OF FIGURES

FIGS. 1A-1E show different views of a base member according to a first embodiment of the present invention, before tightening the bolt.

FIG. 1A shows a perspective view of a base member (1). The base member (1) comprises a bottom plate (2) and a connection profile (3). The bottom plate (2) is an elongated plate that extends in a first direction. The bottom plate (2) comprises two holes (4) for attaching the base member (1) to the surface. The holes (4) are positioned at two opposite sides of the connection profile (3) according to the first direction. The connection profile (3) is firmly fixed to the bottom plate (2). The connection profile (3) has a rectangular cross-section. The connection profile (3) extends in a direction transverse to the bottom plate (2). The connection profile (3) comprises a first pair of cuts. The cuts are U-shaped cuts. A U-shaped cut comprises two legs (13) and a cross-connection (14). The cuts form pliable lips. The pliable lips extend in a direction transverse to the bottom plate (2). This means that the legs (13) are oriented transverse to the bottom plate (2). A first cut of the first pair (9) is comprised in a first side (5) of the connection profile (3). A second cut of the first pair (10) is comprised in a second side (6) of the connection profile (3). The second side (6) is opposite the first side (5). Both the first cut of the first pair (9) and the second cut of the first pair (10) are at a same distance from the bottom plate (2). The first pair of cuts is part of a series of two pairs of cuts. All cuts of pairs of cuts of the series are identical. Subsequent pairs of cuts of the series are at increasing distance from the bottom plate (2). Tips of the pliable lips formed by the cuts of the series are oriented away from the bottom plate (2). This means that an opening (16) between the legs (13) of the cuts of the series are oriented in a same direction towards the bottom plate (2). Consequently, both the pliable lips formed by the first cut of the first pair (9) and the second cut of the first pair (10) are oriented in a same direction. The connection profile (3) has a third side (7) and a fourth side (8). The fourth side (8) is opposite to the third side (7). The third side (7) and the fourth side (8) are transverse to the first side (5) and the second side (6). The third side (7) and the fourth side (8) do not comprise any cut. The connection profile (3) comprises a threaded hole (15) in the pliable lip, meaning in between the legs (13), of the first cut of the first pair (9), in fact between the legs (13) of all cuts comprised in the first side (5) of the connection profile (3). Normally bolts (17) are placed in the threaded holes (15). The bolts (17) are omitted in the FIGS. 1A-1E. FIG. 1A shows the base member (1) before the bolt (17) is tightened. Pliable lips formed by the cuts are still at an original position at the first side (5) and the second side (6).

Figure 1B:
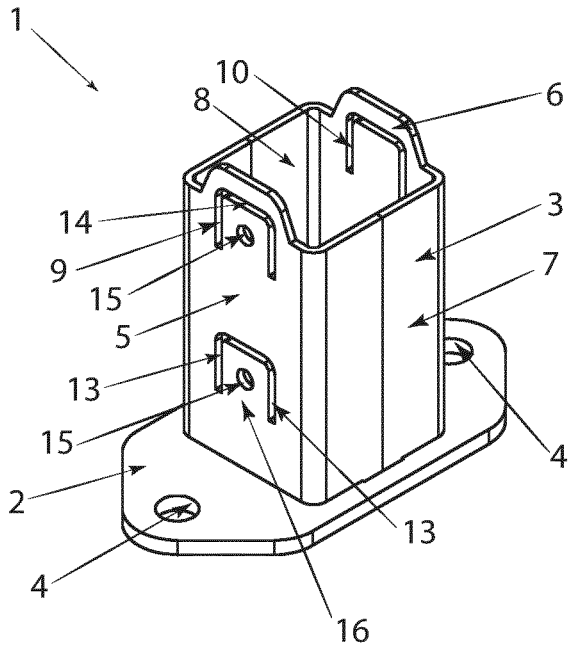
Figure 1C:
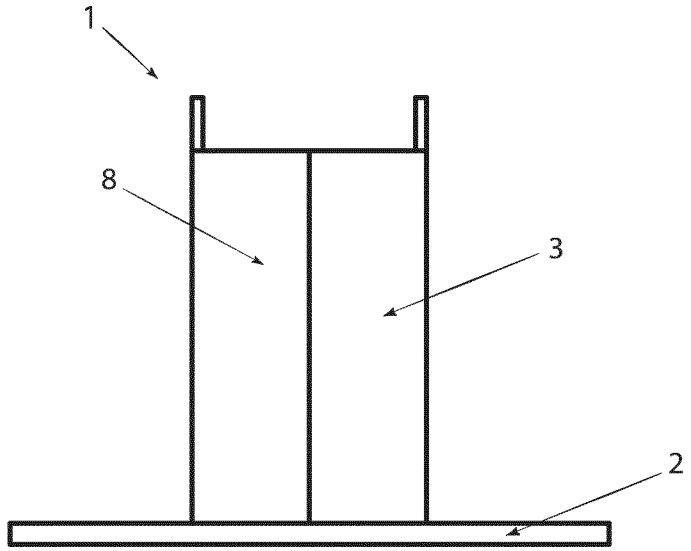
Figure 1D:
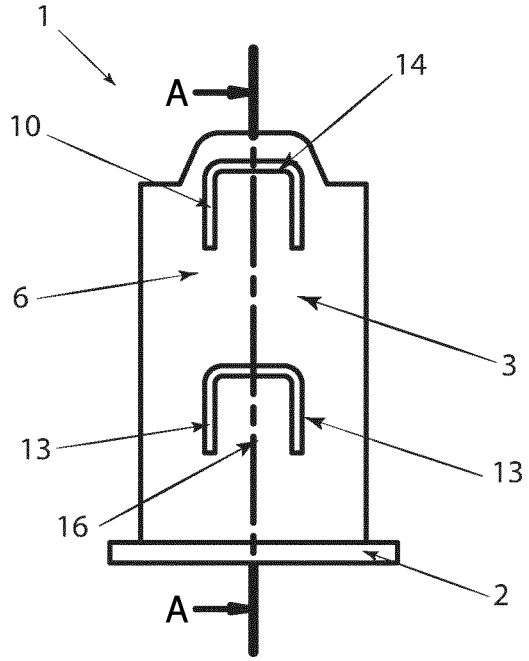
Figure 1E:
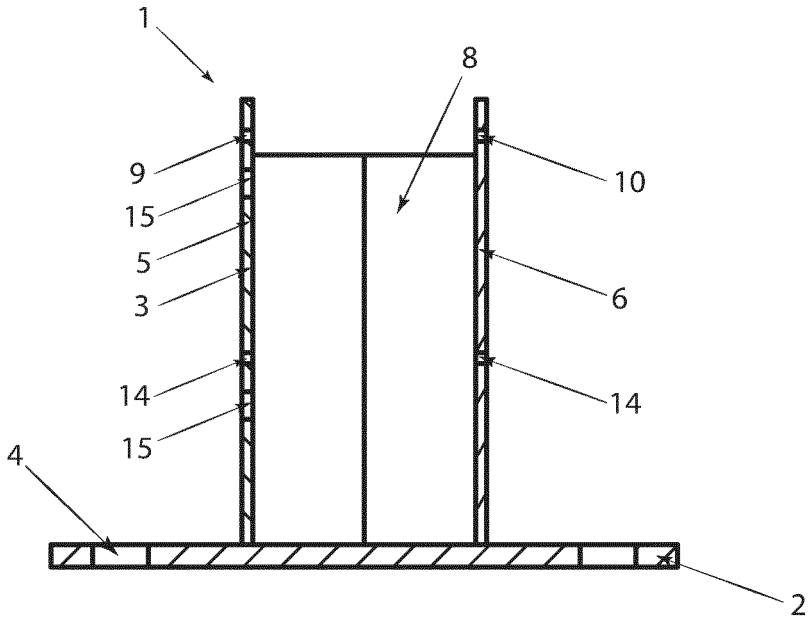

FIG. 1B shows a perspective view of the base member (1), showing the first side (5) of the connection profile (3). Both threaded holes (15) are clearly visible. FIG. 1C shows a side view of the base member (1), showing the fourth side (8) of the connection profile (3). FIG. 1D shows a side view of the base member (1), showing the second side (6) of the connection profile (3). FIG. 1E shows a cross-section along the line A-A indicated on FIG. 1D.

FIGS. 2A-2E show different views of a base member according to a first embodiment of the present invention, after tightening the bolt.

Figure 2A:
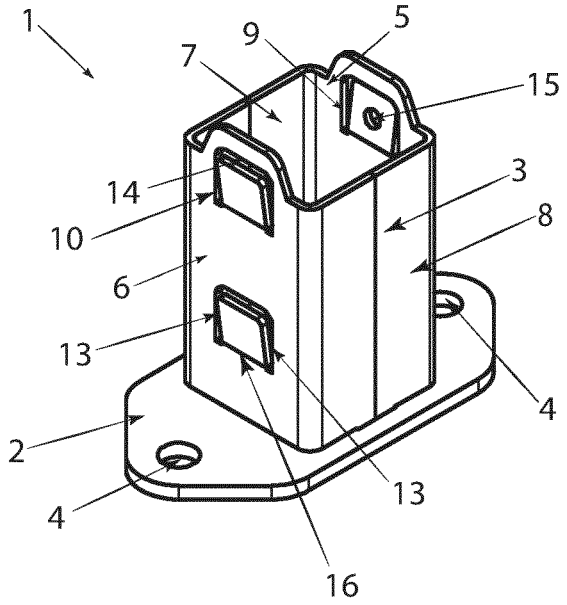
FIGS. 2A-2E show different views of a base member according to a first embodiment of the present invention, after tightening the bolt.
Figure 2B:
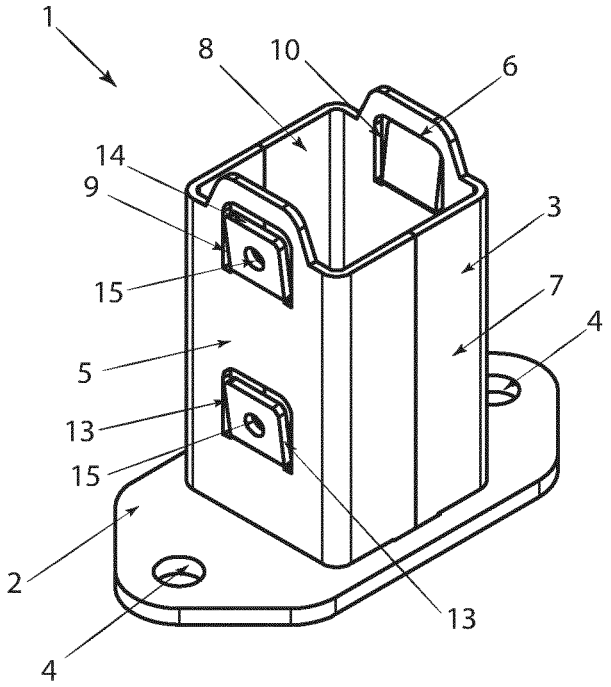
Figure 2C:
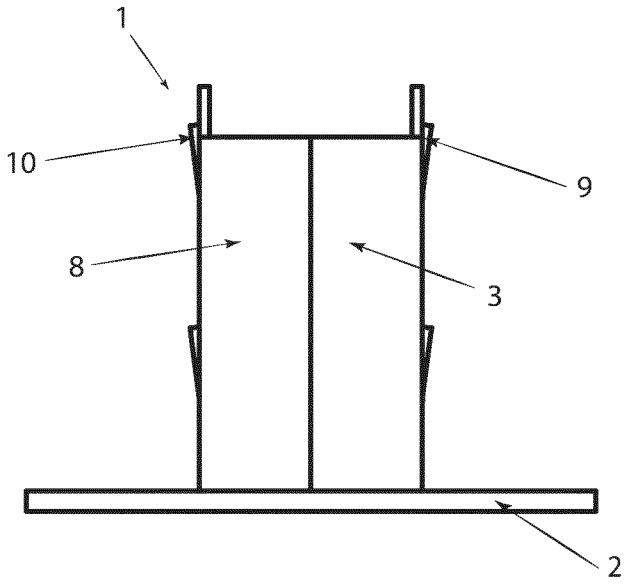
Figure 2D:
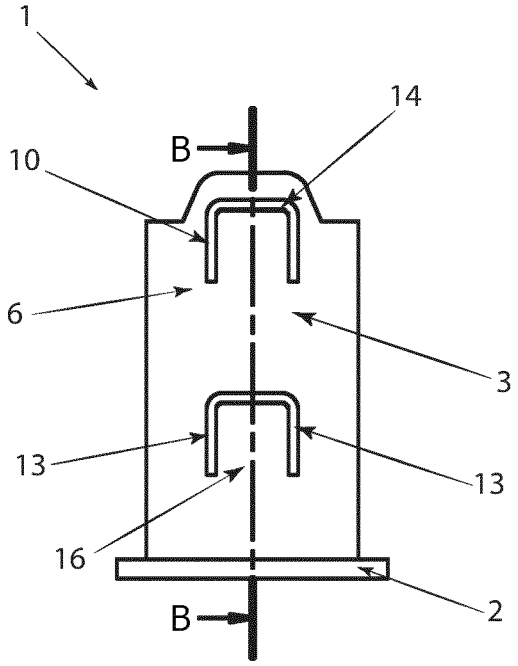
Figure 2E:
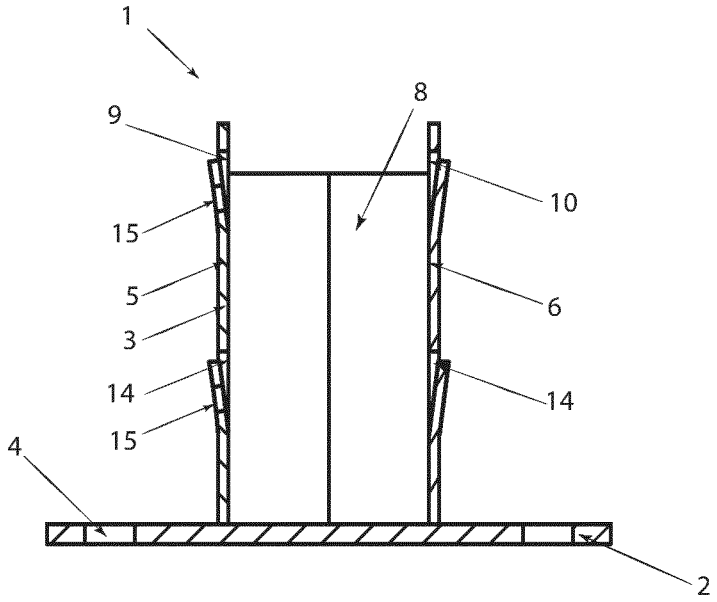

FIG. 2A shows a perspective view of the base member (1) of FIG. 1A, after tightening the bolts (17). The bolts (17) are omitted in the FIGS. 2A-2E. FIG. 2B shows a perspective view of the base member (1), showing the first side (5) of the connection profile (3). FIG. 2C shows a side view of the base member (1), showing the fourth side (8) of the connection profile (3). FIG. 2D shows a side view of the base member (1), showing the second side (6) of the connection profile (3). FIG. 2E shows a cross-section along the line B-B indicated on FIG. 2D.

On FIGS. 2A-2C and 2E is clearly visible how pliable lips formed by the cuts are pushed out the connection profile (3). These pliable lips would clamp against an upwardly extending post (18), slid over the connection profile (3) of the base member (1). The upwardly extending post (18) is just as in the FIGS. 1A-1E not depicted in the FIGS. 2A-2E.

FIGS. 3A-3D show different views of a base member according to a first embodiment of the present invention and an upwardly extending post, before tightening the bolt.

Figure 3A:
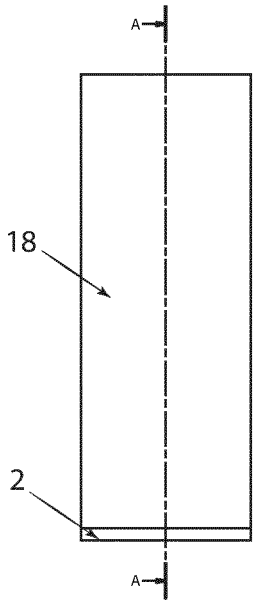
FIGS. 3A-3D show different views of a base member according to a first embodiment of the present invention and an upwardly extending post, before tightening the bolt.
Figure 3B:
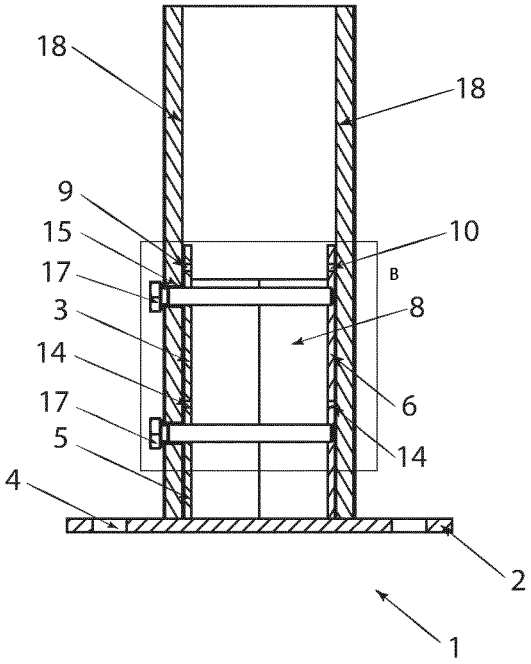
Figure 3C:
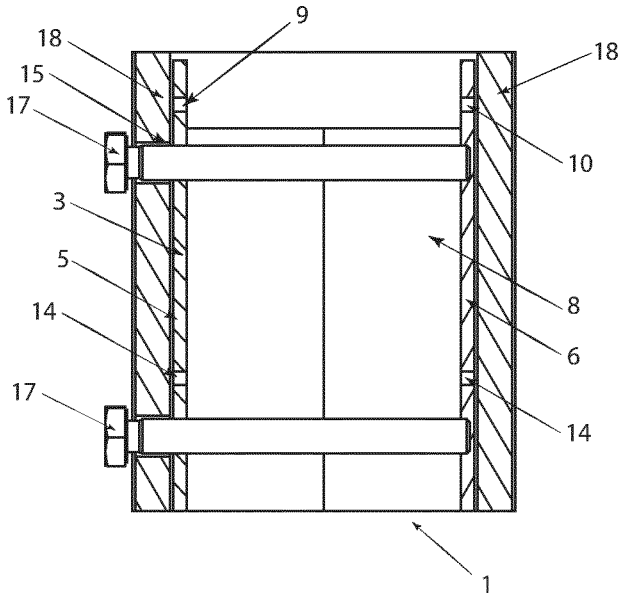
Figure 3D:
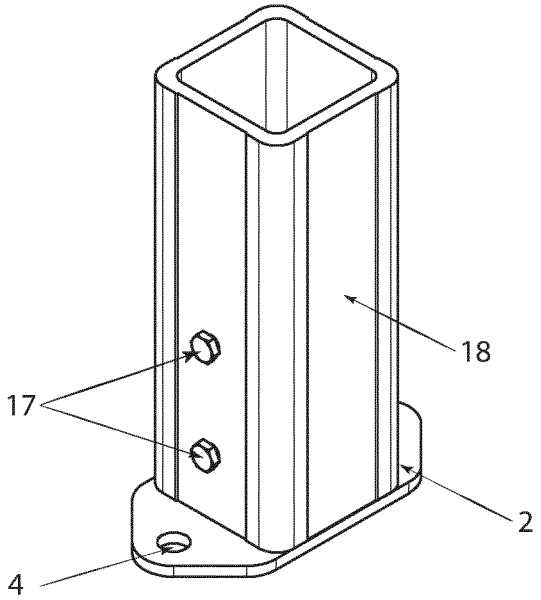

FIG. 3A shows a side view of the base member (1) of FIG. 1D. The side view is the same side view as in FIG. 1D. The difference is that in this case an upwardly extending post (18) is slid over the connection profile (3), almost completely hiding the base member (1), with exception of the bottom plate (2). The upwardly extending post (18) is an elongated hollow profile. FIG. 3B is a cross-section along the line A-A indicated in FIG. 3A. It corresponds with the view of FIG. 1E, with the addition of the upwardly extending post (18) and the bolts (17). It is clearly visible that the bolts (17) are placed inside the threaded holes (15), but are not yet tightened. FIG. 3C is detail B of FIG. 3B. FIG. 3D shows a perspective view corresponding to FIG. 1B, with the addition of the upwardly extending post (18) and the bolts (17). Also, on FIG. 3D one can clearly see that the bolts (17) are not tightened.

FIGS. 4A-4D show different views of a base member according to a first embodiment of the present invention and an upwardly extending post, after tightening the bolt.

Figure 4A:
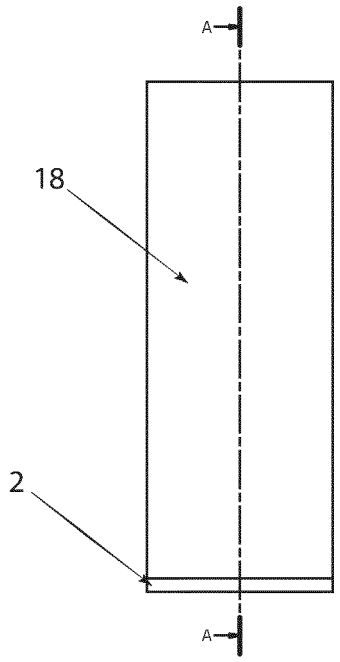
FIGS. 4A-4D show different views of a base member according to a first embodiment of the present invention and an upwardly extending post, after tightening the bolt.
Figure 4B:
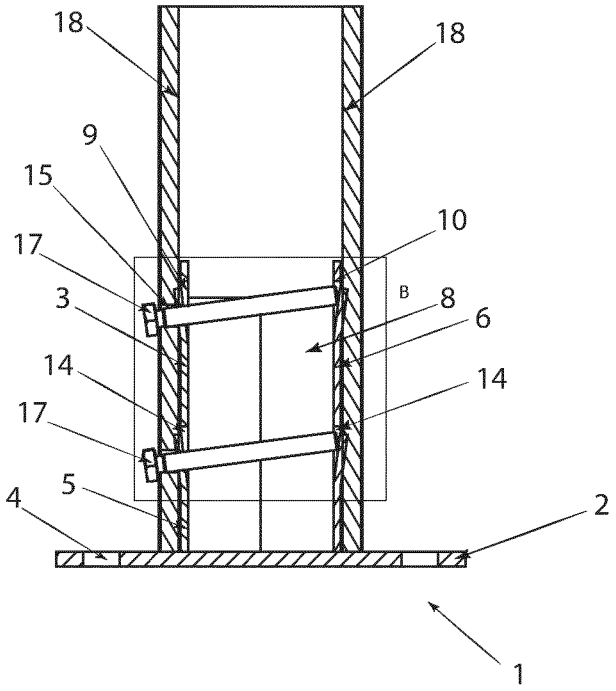
Figure 4C:
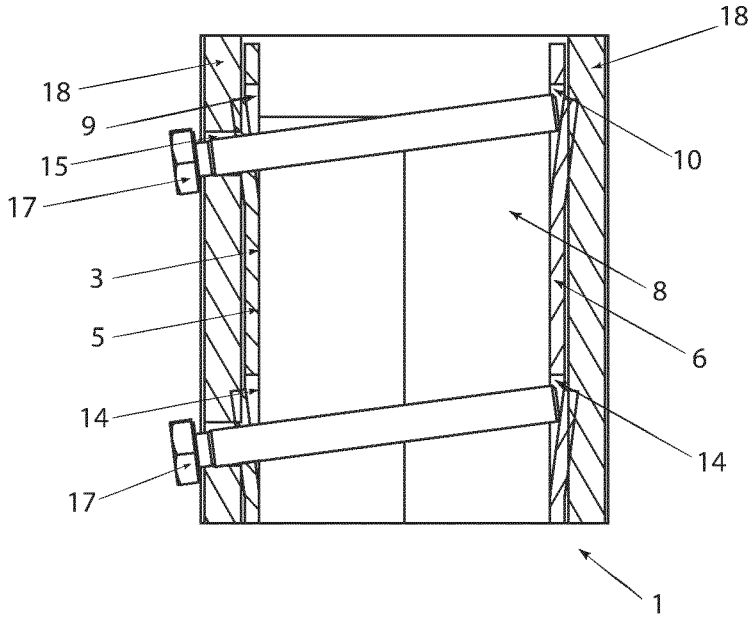
Figure 4D:
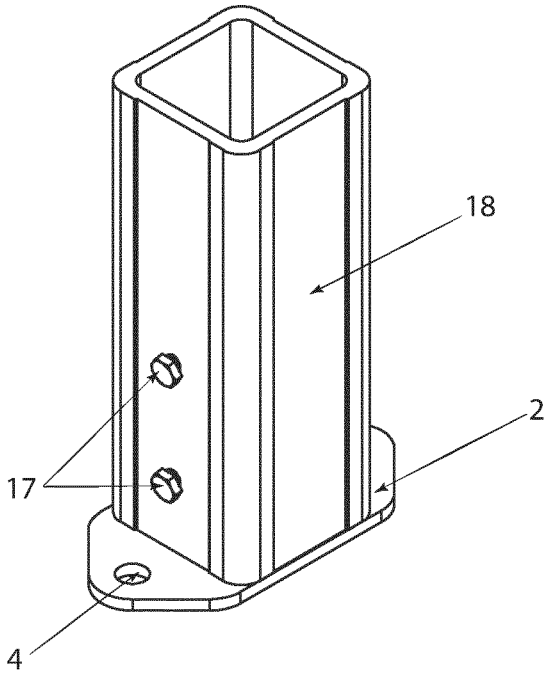

FIG. 4A shows a side view of the base member (1) of FIG. 2D. The side view is the same side view as in FIG. 2D. The difference is that in this case an upwardly extending post (18) is slid over the connection profile (3), almost completely hiding the base member (1), with exception of the bottom plate (2). The upwardly extending post (18) is an elongated hollow profile. FIG. 4B is a cross-section along the line A-A indicated in FIG. 4A. It corresponds with the view of FIG. 2E, with the addition of the upwardly extending post (18) and the bolts (17). It is clearly visible that the bolts (17) are placed inside the threaded holes (15). The bolts (17) are tightened. It is clearly visible that the pliable lips formed by the cuts are pushed out the connection profile (3). These pliable lips clamp against the upwardly extending post (18) and partly penetrate a surface at an inside of the upwardly extending post (18). FIG. 4C is detail B of FIG. 4B. FIG. 4D shows a perspective view corresponding to FIG. 2B, with the addition of the upwardly extending post (18) and the bolts (17).

FIGS. 5A-5E show different views of a base member according to a first embodiment of the present invention.

Figure 5A:
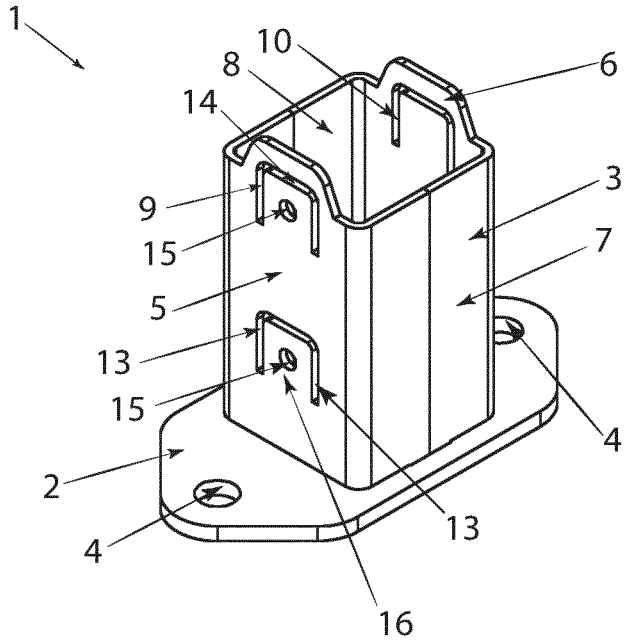
FIGS. 5A-5E show different views of a base member according to a first embodiment of the present invention.
Figure 5B:
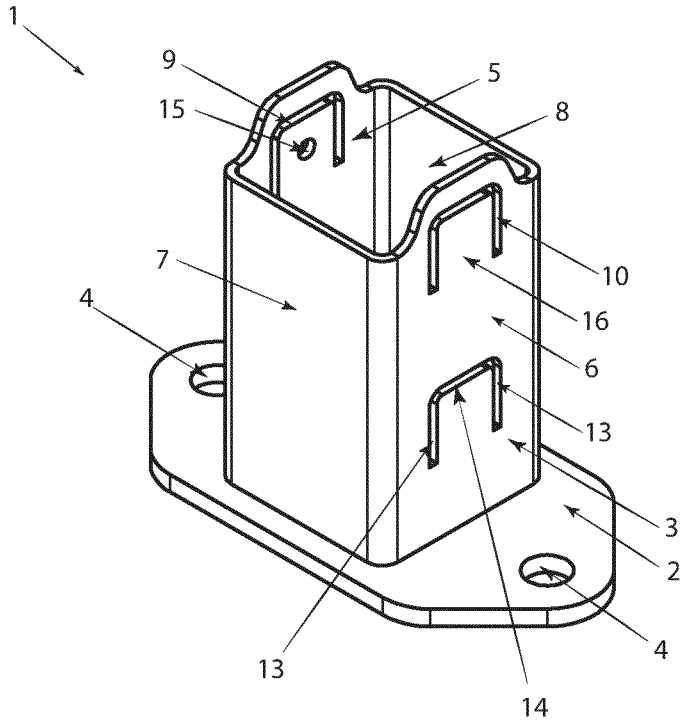
Figure 5C:
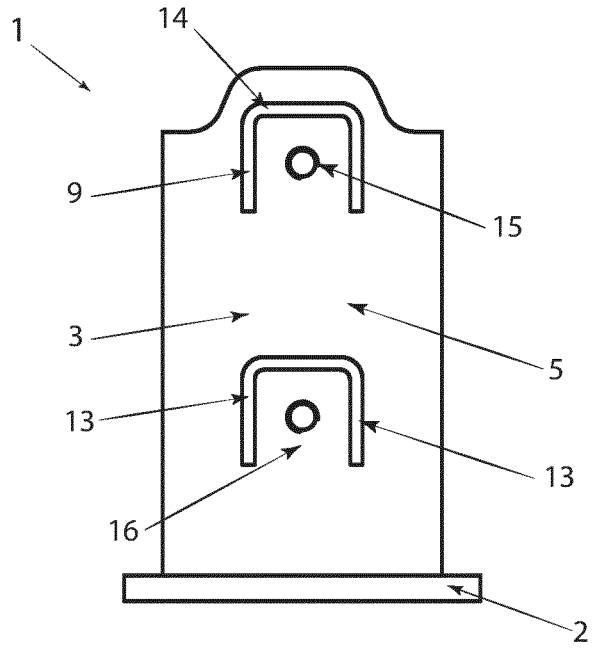
Figure 5D:
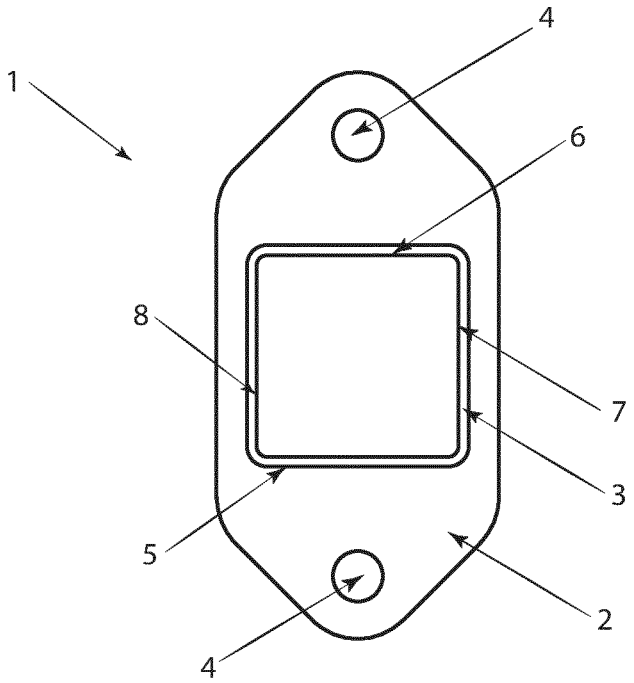
Figure 5E:
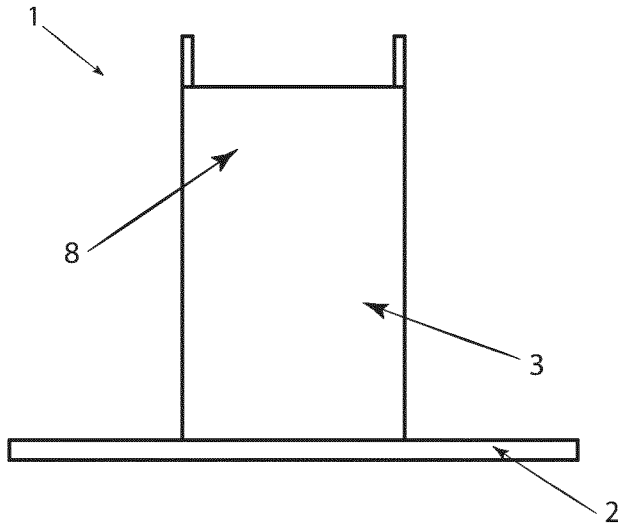
Figure 6A:
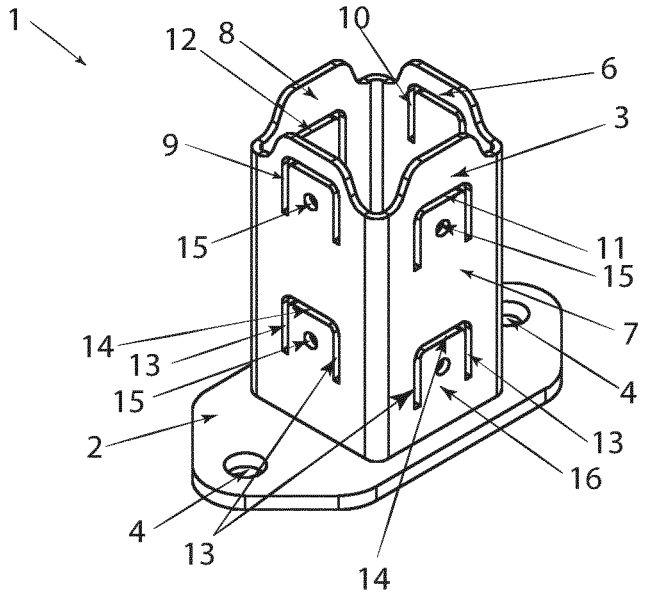
FIGS. 6A-6E show different views of a base member according to a second embodiment of the present invention.
Figure 6B:
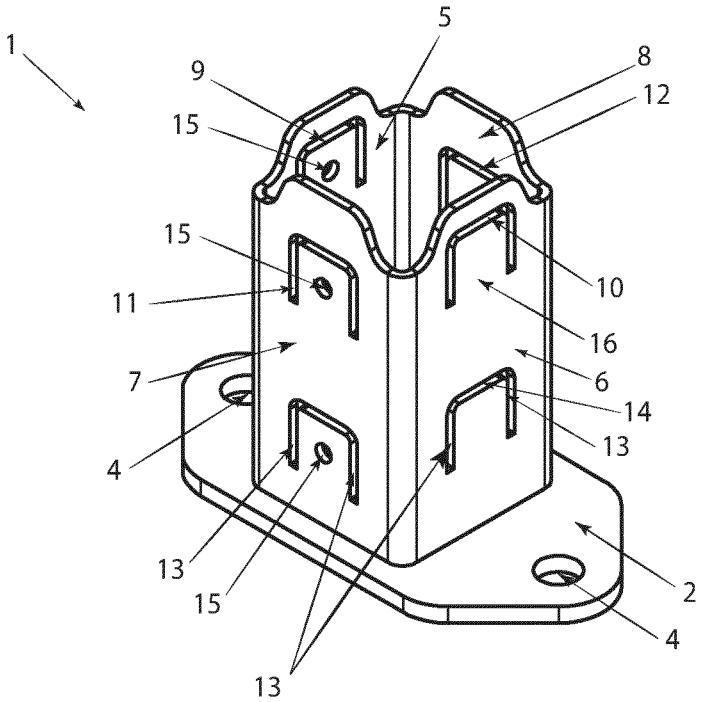
Figure 6C:
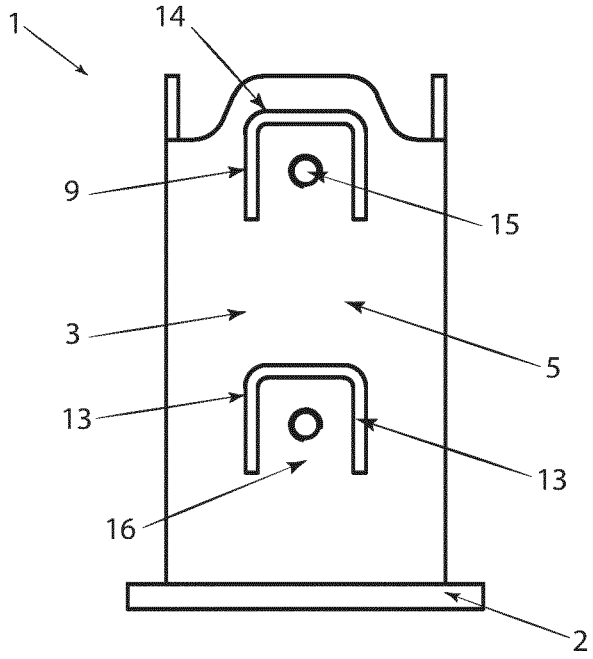
Figure 6D:
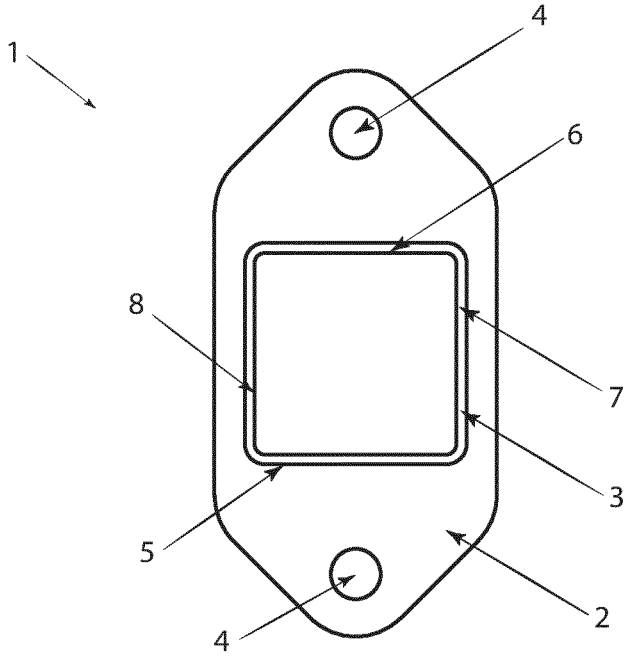
Figure 6E:
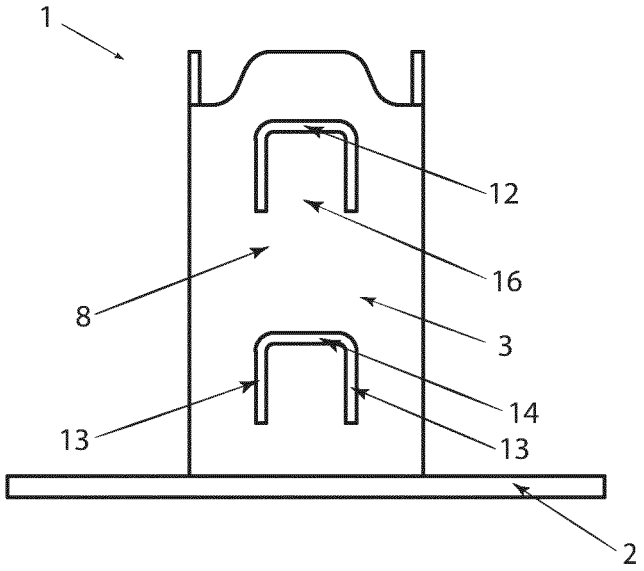
Figure 7A:
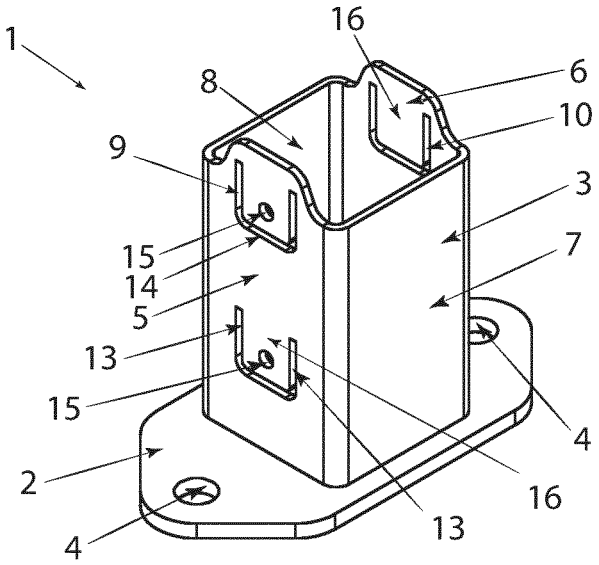
FIGS. 7A-7E show different views of a base member according to a third embodiment of the present invention.
Figure 7B:
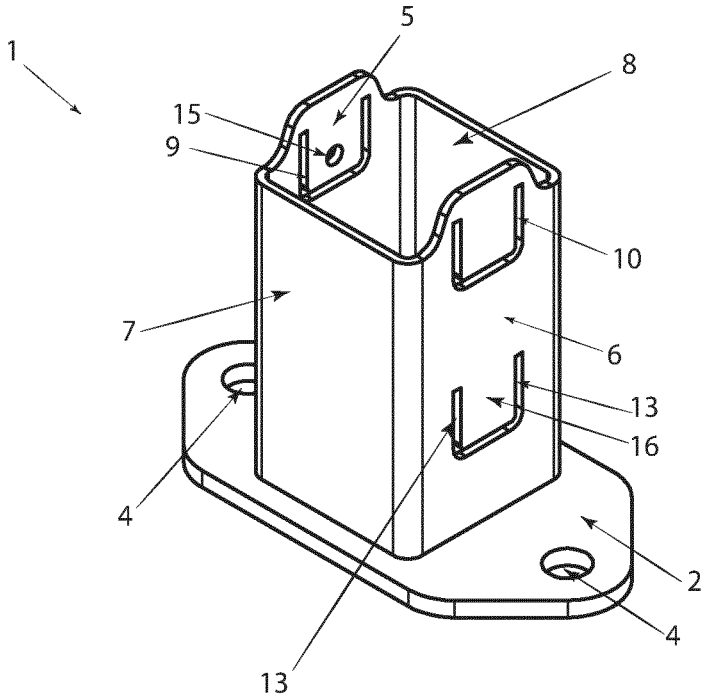
Figure 7C:
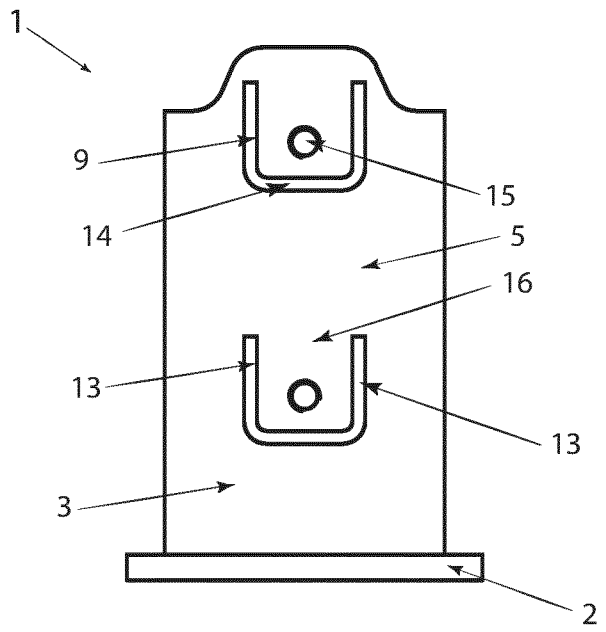
Figure 7D:
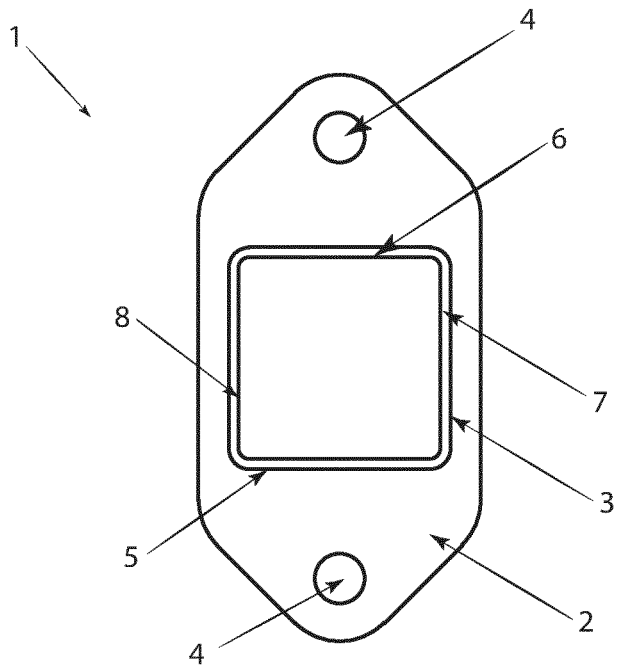
Figure 7E:
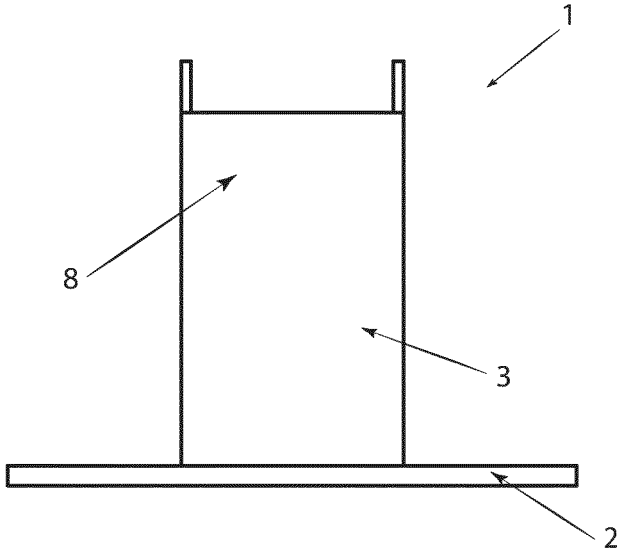
Figure 8A:
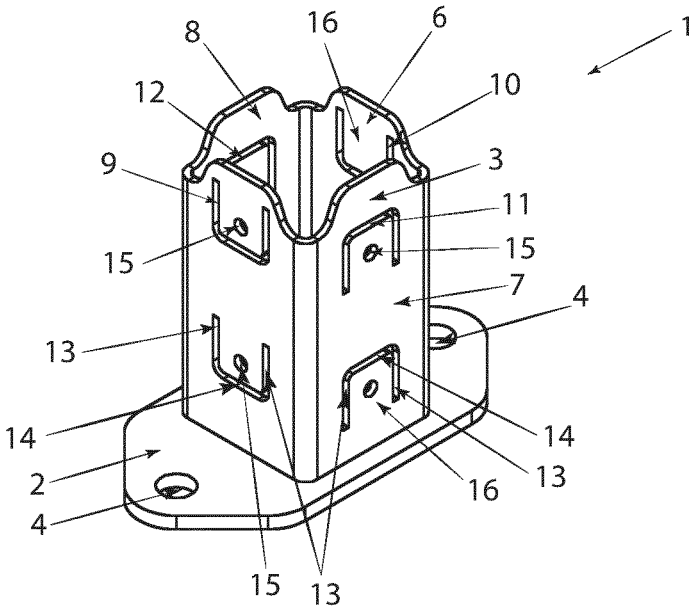
FIGS. 8A-8E show different views of a base member according to a fourth embodiment of the present invention.
Figure 8B:
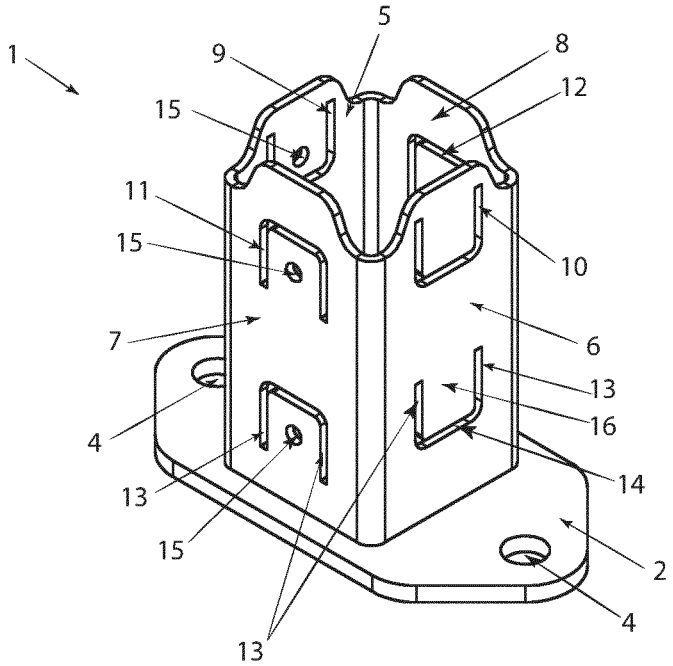
Figure 8C:
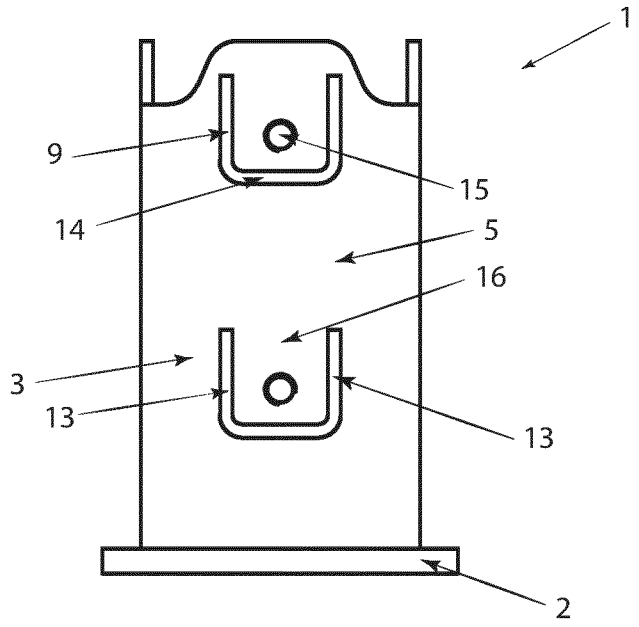
Figure 8D:
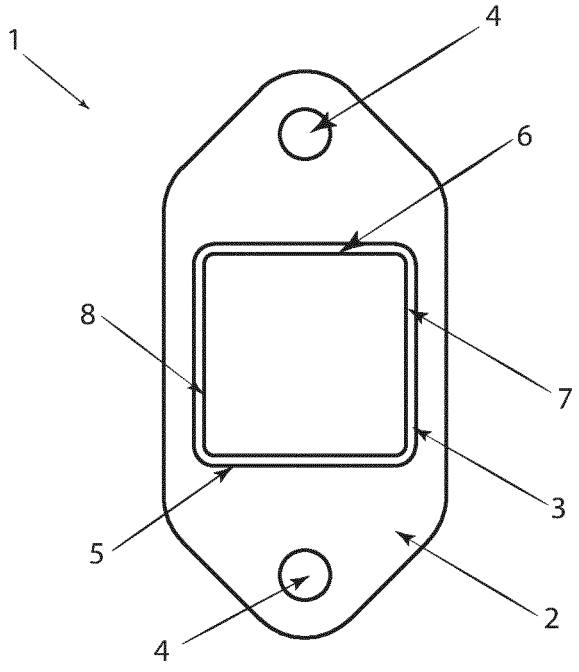
Figure 8E:
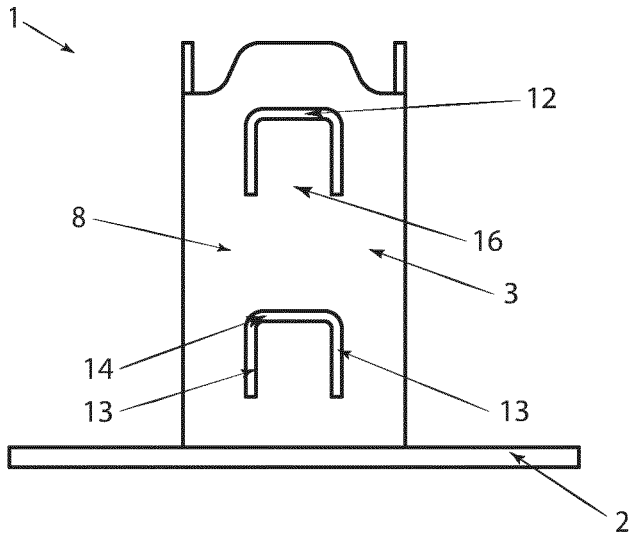
Figure 9A:
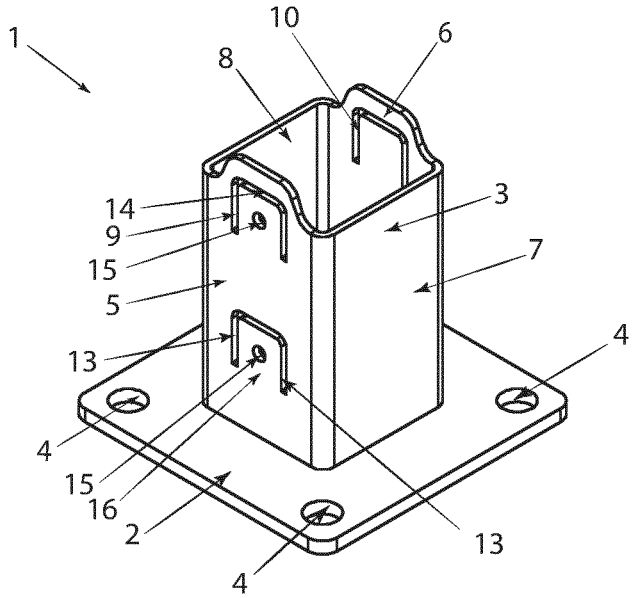
FIGS. 9A-9E show different views of a base member according to a fifth embodiment of the present invention.
Figure 9B:
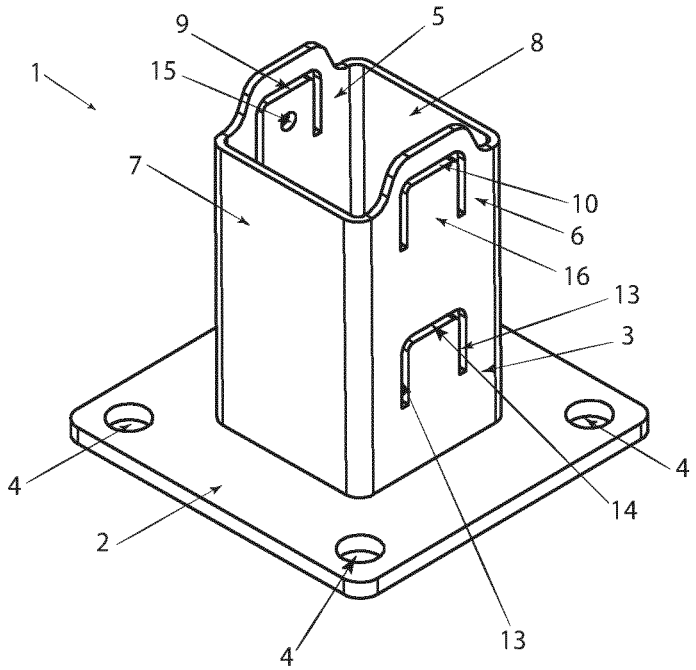
Figure 9C:
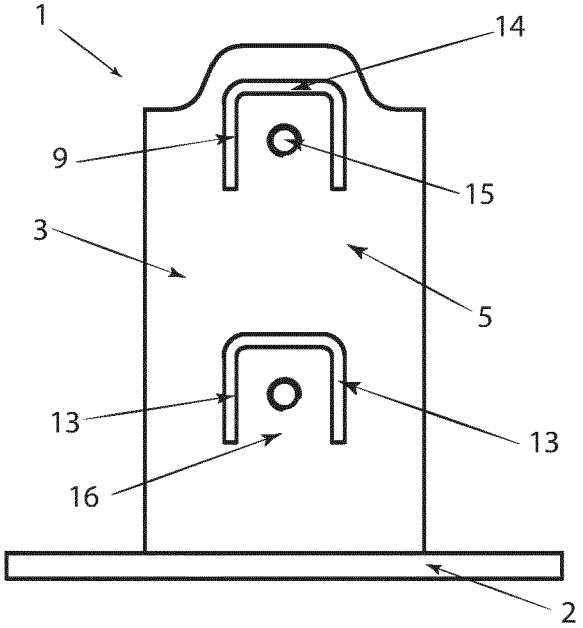
Figure 9D:
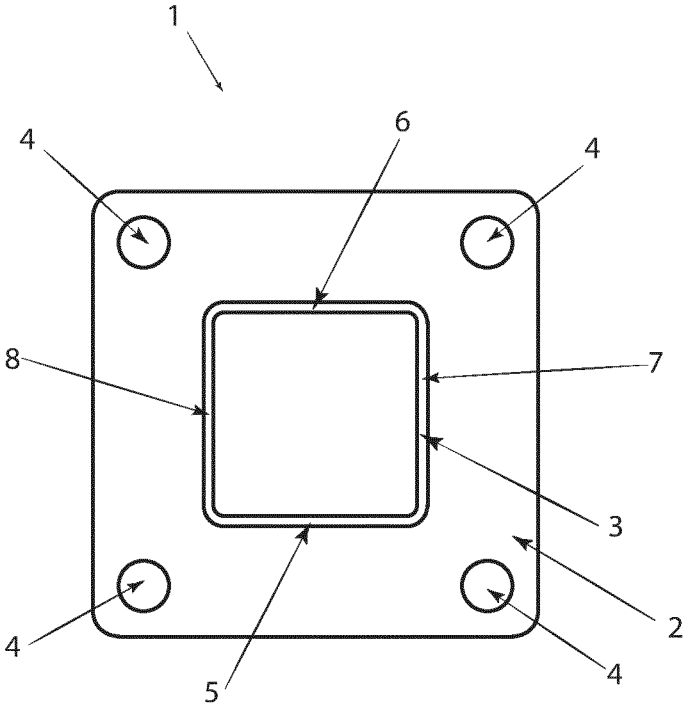
Figure 9E:
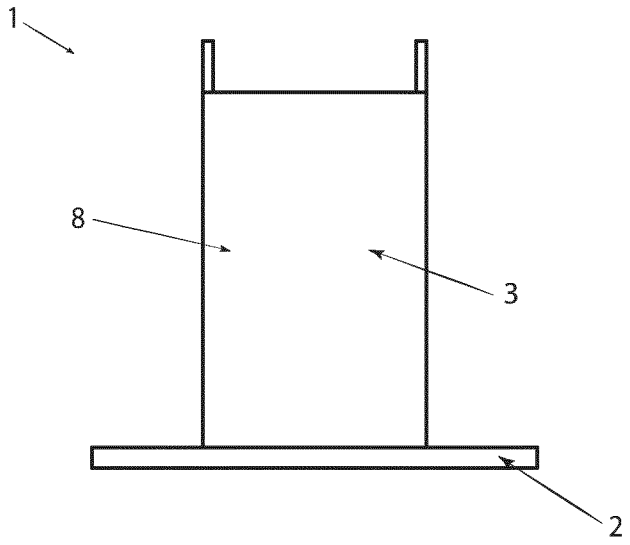
Figure 10:
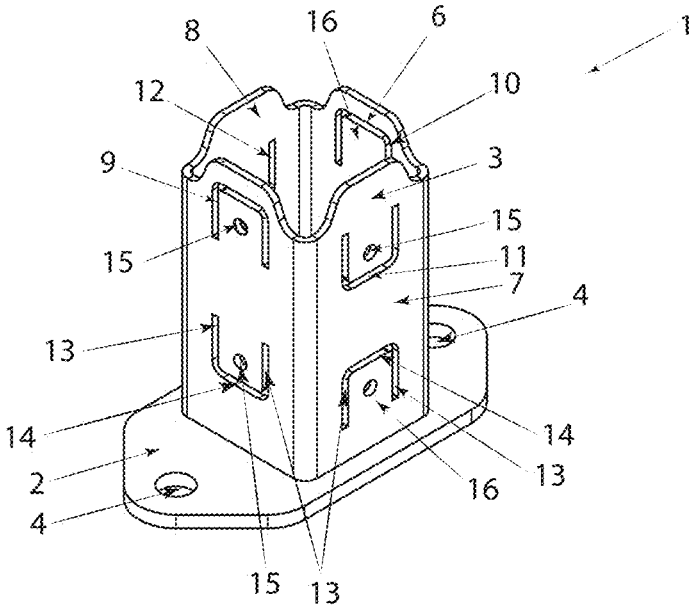
FIG. 10 shows a perspective view a base member according to a sixth embodiment of the present invention.
Figure 11:
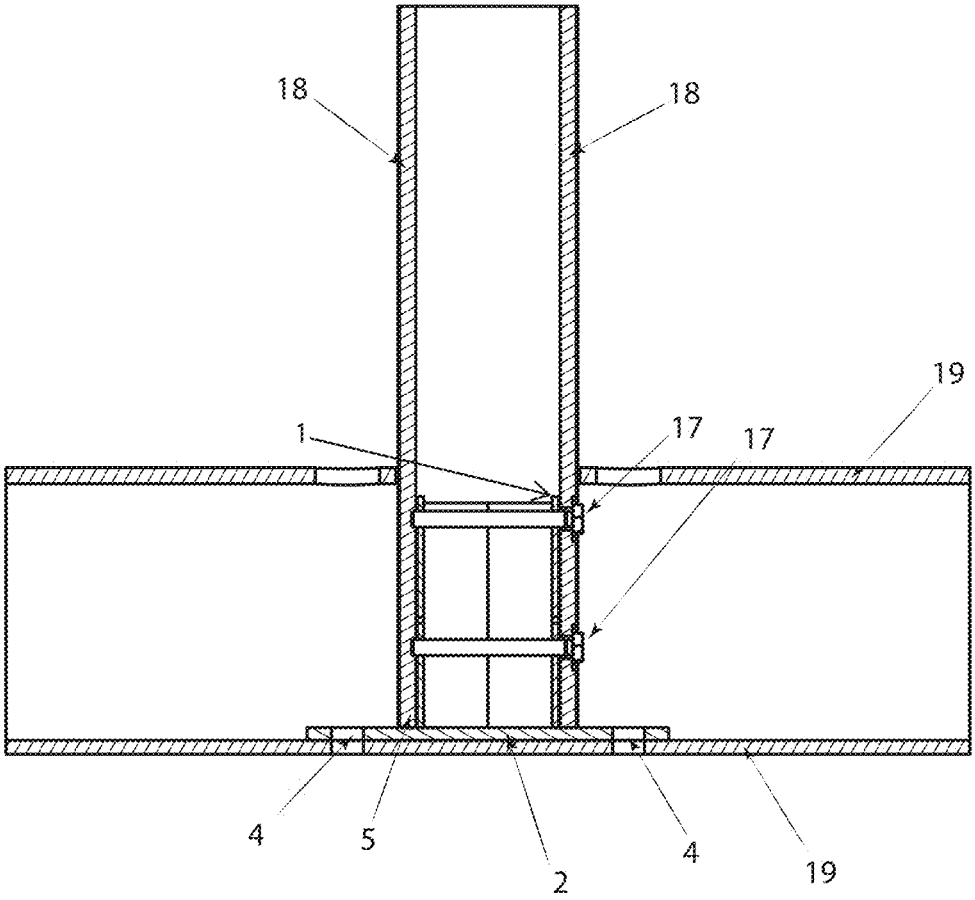
FIG. 11 shows a sectional side view of a curb barrier with a base member inserted therein according to one or more embodiments of the present invention.

The base member (1) corresponds to the base member (1) depicted in the FIGS. 1A-1E. FIG. 5A shows a perspective view of the base member (1), showing the first side (5) of the connection profile (3). FIG. 5B shows a perspective view of the base member (1), showing the third side (7) of the base member (1). FIG. 5C shows a side view of the base member (1), showing the first side (5) of the connection profile (3). FIG. 5D shows a top view of the base member (1). FIG. 5E shows a side view of the base member (1), showing the fourth side (8) of the connection profile (3).

FIGS. 6A-6E show different views of a base member according to a second embodiment of the present invention.

The base member (1) depicted in the FIGS. 6A-6E is almost identical to the base member (1) depicted in FIGS. 5A-5E. The views of FIGS. 6A-6E correspond with the views of FIGS. 5A-5E. The difference between the base members (1) of FIGS. 6A-6E and FIGS. 5A-5E is that the connection profile (3) of the base member (1) of FIGS. 6A-6E comprises a second pair of cuts. A first cut of the second pair (11) is comprised in the third side (7) of the connection profile (3). A second cut of the second pair (12) is comprised in the fourth side (8) of the connection profile (3). Both the first cut of the second pair (11) and the second cut of the second pair (12) are at a same distance from the bottom plate (2). The second pair of cuts is part of a second series of two pairs of cuts. All cuts of pairs of cuts of the second series are identical. Subsequent pairs of cuts of the second series are at increasing distance from the bottom plate (2). Tips of the pliable lips formed by the cuts of the series are oriented away from the bottom plate (2). This means that an opening (16) between the legs (13) of the cuts of the second series are oriented in a same direction towards the bottom plate (2). Consequently, both pliable lips formed by the first cut of the second pair (11) and the second cut of the second pair (12) are oriented in a same direction. The pliable lips formed by the first cut of the second pair (11) and the second cut of the second pair (12) are also oriented in the same direction as the first cut of the first pair (9) and the second cut of the first pair (10). The connection profile (3) comprises a threaded hole (15) in the pliable lip, meaning in between the legs (13), of the first cut of the second pair (11), in fact between the legs (13) of all cuts comprised in the third side (7) of the connection profile (3). Normally bolts (17) are placed in the threaded holes (15). The bolts (17) are omitted in the FIGS. 6A-6E.

FIGS. 7A-7E show different views of a base member according to a third embodiment of the present invention.

The base member (1) depicted in the FIGS. 7A-7E is almost identical to the base member (1) depicted in FIGS. 5A-5E. The views of FIGS. 7A-7E correspond with the views of FIGS. 5A-5E. The difference between the base members (1) of FIGS. 7A-7E and FIGS. 5A-5E is that the pliable lips formed by the cuts of the series comprising the first cut of the first pair (9) are oriented in a same direction towards the bottom plate (2), meaning that the opening (16) between the legs (13) of the cuts of the series comprising the first cut of the first pair (9) are oriented in a same direction away from the bottom plate (2).

FIGS. 8A-8E show different views of a base member according to a fourth embodiment of the present invention.

The base member (1) depicted in the FIGS. 8A-8E is almost identical to the base member (1) depicted in FIGS. 6A-6E. The views of FIGS. 8A-8E correspond with the views of FIGS. 6A-6E. The difference between the base members (1) of FIGS. 8A-8E and FIGS. 6A-6E is that the pliable lips formed by the cuts of the series comprising the first cut of the first pair (9) are oriented in a same direction towards the bottom plate (2), meaning that opening (16) between the legs (13) of the cuts of the series comprising the first cut of the first pair (9) are oriented in a same direction away from the bottom plate (2).

FIGS. 9A-9E show different views of a base member according to a fifth embodiment of the present invention.

The base member (1) depicted in the FIGS. 9A-9E is almost identical to the base member (1) depicted in FIGS. 5A-5E. The views of FIGS. 9A-9E correspond with the views of FIGS. 5A-5E. The difference between the base members (1) of FIGS. 9A-9E and FIGS. 5A-5E is that the bottom plate (2) has a rectangular shape corresponding with the rectangular cross-section of the connection profile (3). The connection profile (3) is centrally placed inside the circumference of the bottom plate (2). The bottom plate (2) comprises four holes (4) for attaching the base member (1) to a surface. The bottom plate (2) comprises a hole (4) in each corner of the bottom plate (2).

REFERENCE NUMBERS USED IN THE FIGURES ARE

1. Base member
2. Bottom plate
3. Connection profile
4. Hole
5. First side
6. Second side
7. Third side
8. Fourth side
9. First cut of first pair
10. Second cut of first pair
11. First cut of second pair
12. Second cut of second pair
13. Leg
14. Cross-connection
15. Threaded hole
16. Opening
17. Bolt
18. Upwardly extending post
19. Curb (kerb) barrier

The invention claimed is:

1. A base member for attaching an upwardly extending post to a surface, comprising:

a bottom plate; and a hollow connection profile for connecting the upwardly extending post to the base member, wherein the connection profile is firmly fixed to the bottom plate and extends in a direction transverse to the bottom plate, and wherein the connection profile includes at least a first pair of cuts, wherein a cut forms a pliable lip, wherein the pliable lip extends in a direction transverse to the bottom plate, wherein a first cut of said first pair is in a first side of the connection profile and a second cut of said first pair is in a second side of the connection profile, opposite said first side, wherein both cuts of said first pair are at a same distance from the bottom plate, wherein both pliable lips formed by the cuts of said first pair are oriented in a same direction, wherein the base member comprises a bolt, and wherein said bolt is placed in a threaded hole in the pliable lip formed by the first cut of said first pair.

2. The base member according to claim 1, wherein the connection profile includes at least a second pair of cuts, wherein a cut forms a pliable lip, wherein the pliable lip extends in a direction transverse to the bottom plate, wherein a first cut of said second pair is in a third side of the connection profile and a second cut of said second pair is in a fourth side of the connection profile, opposite said third side, wherein the third side and the fourth side of the connection profile are transverse to the first side and the second side of the connection profile, wherein both cuts of said second pair are at a same distance from the bottom plate, wherein both pliable lips formed by the cuts of said second pair are oriented in a same direction, wherein the base member comprises a second bolt, wherein said second bolt is placed in a threaded hole in the pliable lip formed by the first cut of said second pair and wherein the second bolt in the pliable lip formed by the first cut of said second pair is at a different distance from the bottom plate than the bolt in the pliable lip formed by the first cut of said first pair.

3. The base member according to claim 2, wherein a tip of the pliable lips formed by the cuts of said first pair are oriented towards the bottom plate and a tip of the pliable lips formed by the cuts of said second pair are oriented away from the bottom plate.

4. The base member of claim 2, wherein a tip of the pliable lips formed by the cuts of said first pair and a tip of the pliable lips formed by the cuts of said second pair are oriented in a same direction away from the bottom plate or towards the bottom plate.

5. The base member according to claim 1, wherein a pair of cuts is part of a series of at least two pairs of cuts, wherein each subsequent pair of cuts of said series is located at increasing distance from said bottom plate.

6. The base member according to claim 5, wherein the pliable lips formed by the cuts of all pairs of said series are oriented in a same direction.

7. The base member according to claim 5, wherein pliable lips formed by the cuts of subsequent pairs of said series are oriented in opposite directions.

8. The base member according to claim 1, wherein at least one of the bottom plate and the hollow connection profile is made of steel.

9. The base member according to claim 1, wherein the bolt placed in a threaded hole in a pliable lip formed by a cut of a pair of cuts has a length which is at least 5 mm and at most 15 mm longer than a distance between the two opposite sides of the connection profile comprising said cuts of said pair.

10. The base member of claim 1, wherein the hollow connection profile firmly attaches the upwardly extending post to the base member such that the upwardly extending post does not detach from the base member in the event of a mechanical impact on the upwardly extending post, and wherein the upwardly extending post can be replaced in the event of damage in a collision while the base member can be reused.

11. A method for attaching an upwardly extending post to a surface comprising the steps of:

providing a base member, wherein the base member comprises a bottom plate and a hollow connection profile for connecting the upwardly extending post to the base member, wherein the connection profile is firmly fixed to the bottom plate, wherein the connection profile extends in a direction transverse to the bottom plate;

attaching the base member to the surface;

sliding the upwardly extending post over the connection profile; and attaching the upwardly extending post to the connection profile by the use of a bolt, wherein the connection profile includes at least a first pair of cuts, wherein a cut forms a pliable lip, wherein the pliable lip extends in a direction transverse to the bottom plate, wherein a first cut of said first pair is comprised in a first side of the connection profile and a second cut of said first pair in a second side of the connection profile, opposite said first side, wherein both cuts of said first pair are at a same distance from the bottom plate, wherein both pliable lips formed by the cuts of said first pair are oriented in a same direction, wherein said bolt is placed in a threaded hole in the pliable lip formed by the first cut of said first pair, and wherein said bolt is tightened until the pliable lips formed by the first cut and the second cut are clamped against the upwardly extending post.

12. The method according to claim 11, further comprising attaching the upwardly extending post to the connection profile by the use of a second bolt, wherein the connection profile includes at least a second pair of cuts, wherein a cut forms a pliable lip, wherein the pliable lip extends in a direction transverse to the bottom plate, wherein a first cut of said second pair is comprised in a third side of the connection profile and a second cut of said second pair in a fourth side of the connection profile, opposite said third side, wherein the third side and the fourth side of the connection profile are transverse to the first side and the second side of the connection profile, wherein both cuts of said second pair are at a same distance from the bottom plate, wherein both pliable lips formed by the cuts of said second pair are oriented in a same direction, wherein said second bolt is placed in a threaded hole in the pliable lip formed by the first cut of said second pair, wherein said second bolt in the pliable lip formed by the first cut of said second pair is at a different distance from the bottom plate than the bolt in the pliable lip formed by the first cut of said first pair, and wherein said second bolt is tightened until the pliable lips formed by the first cut and the second cut of the second pair are clamped against the upwardly extending post.

13. The method according to claim 11, wherein a pair of cuts is part of a series of at least two pairs of cuts, wherein each subsequent pair of cuts of said series is located at increasing distance from said bottom plate.

14. The method according to claim 11, further comprising placing a curb barrier, wherein the base member is placed hidden inside the curb barrier, wherein the upwardly extending post is slid over the connection profile through the curb barrier and wherein the bolt is tightened through an open end of the curb barrier.

15. The method according to claim 11, further comprising removing the upwardly extending post after untightening the bolt.

* * * * *